US006335153B1

(12) United States Patent
Toya

(10) Patent No.: US 6,335,153 B1
(45) Date of Patent: Jan. 1, 2002

(54) METHOD FOR PRODUCING IMAGE USING A PHOTOTHERMOGRAPHIC MATERIAL

(75) Inventor: Ichizo Toya, Minami-ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/594,841

(22) Filed: Jun. 15, 2000

(30) Foreign Application Priority Data

Jun. 15, 1999 (JP) ..... 11-167777

(51) Int. Cl.[7] ..... G03C 5/16; G03C 1/09; G03C 1/498

(52) U.S. Cl. ..... 430/350; 430/363; 430/604; 430/619; 430/945; 355/83

(58) Field of Search ..... 430/350, 619, 430/363, 604, 945; 355/30, 83, 84, 85; 250/591, 339.03, 370.15

(56) References Cited

U.S. PATENT DOCUMENTS 3,152,904 A 10/1964 Sorensen et al.
3,457,075 A 7/1969 Morgan et al.
5,414,488 A * 5/1995 Fujita et al. ..... 355/30
5,948,608 A * 9/1999 Inagaki ..... 430/619
5,965,348 A 10/1999 Toya
5,998,126 A 12/1999 Toya et al.
5,998,127 A 12/1999 Toya et al.

OTHER PUBLICATIONS

Donald H. Klosterboer, Thermally Processed Silver Systems; Research Dept., Anacomp Engineering Div., San Diego, CA; pp. 279–291.

* cited by examiner

*Primary Examiner*—Thorl Chea
(74) *Attorney, Agent, or Firm*—Birch, Stewart, Kolasch & Birch, LLP

(57) ABSTRACT

Provided is a method for producing image using a photothermographic material in which the photothermographic material is exposed with a laser light using an image producing apparatus having a recording section and heat developing section, and then developed by heating, the photothermographic material containing elsewhere at least on one plane of the a support at least one kind of photosensitive silver halide, a non-photosensitive organic silver salt, a reducing agent for silver ion and a binder; characterized in that the photosensitive silver halide contains an iridium compound, and the image producing apparatus has an exposure corrective control means for correctively controlling exposure output according to a temperature profile of photothermographic material within the apparatus. This method can provide an image with a stable quality while not being affected by environmental conditions during the image production.

12 Claims, 4 Drawing Sheets

METHOD FOR PRODUCING IMAGE USING A PHOTOTHERMOGRAPHIC MATERIAL

TECHNICAL FIELD

The present invention relates to a method for producing image using a photothermographic material well applicable to an image producing system typically for medical diagnosis.

RELATED ART

As general image producing systems, a variety of hard copy systems making use of pigments or dyes are prevailing, which are typified by an ink jet printer and electronic photographing apparatus, for example. These image producing systems are, however, not satisfactory for medical use in which advanced levels of fine depiction, sharpness and graininess are required. A blue-black tone for facilitating diagnoses is preferred in medical use, and also an image producing system which produces only a few waste process solution is preferred from the viewpoint of environmental preservation and space saving.

In relation to an image producing system for medical use meeting the foregoing demands, a technology utilizing a photothermographic material has been developed. This technology has been successful in affording efficient light exposure with a laser image setter or laser imager, providing a sharp and clear black image with a high resolution, and providing a simpler and environment-conscious image producing system using no chemical for treating the solution or the like.

Examples of the image producing system making use of photothermographic material and in particular making use of organic silver salt are disclosed, for example, in U.S. Pat. Nos. 3,152,904 and 3,457,075 and "Thermally Processed Silver Systems—A" by D. Klosterboer, Imaging Processes and Materials, Neblette's 8th ed., edited by Sturge, V. Walworth and A. Shepp, Chapter 9, p.279, (1989).

The photothermographic material generally has a photosensitive layer comprising a silver halide as a photocatalyst, a reducible silver salt such as an organic silver salt, a reducing agent, a binder, and an optional color toner for controlling color tone of silver image, all of which being dispersed in a binder matrix. The photothermographic material having such photosensitive layer produces blackened silver when heated, after light exposure, to a high temperature (e.g. 80° C. or above) through redox reaction of the silver halide or reducible silver salt (acts as an oxidizing agent) with the reducing agent. The redox reaction is promoted by a catalytic action of silver halide composing a latent image generated by the exposure, so that the monotone silver image is formed in the exposed area. An image producing system utilizing such organic silver salt can provide an image quality and tone satisfiable for medical diagnosis.

The image producing system using the conventional photothermographic material is, however, liable to be affected by environmental conditions during the exposure and development. For example, a problem has resided in that a stable finish cannot be expected because of fluctuation in the temperature and humidity depending on the installation environment of an image producing apparatus or frequency of the exposure and development.

Considering such problems in the conventional technology, it is therefore an object of the present invention to provide a method for producing image using a photothermographic material ensuring stable finish irrespective of the installation environment of an image producing apparatus or of fluctuations in the temperature or humidity inside the apparatus during the operations.

SUMMARY OF THE INVENTION

The present inventors found after extensive investigations for achieving the above object that an image with a constant quality can be producible irrespective of the environmental conditions by correctively controlling the exposure output according to a temperature profile of a photothermographic material within an image producing apparatus, which led us to propose the present invention.

That is, the present invention provides a method for producing image using a photothermographic material in which the photothermographic material is exposed with a laser light using an image producing apparatus having a recording section and heat developing section, and then developed by heating, the photothermographic material containing at least elsewhere on one plane of the support at least one kind of photosensitive silver halide, a non-photosensitive organic silver salt, a reducing agent for silver ion and a binder; characterized in that the photosensitive silver halide contains an iridium compound, and the image producing apparatus has an exposure corrective control means for correctively controlling the exposure output according to a temperature profile of the photothermographic material within said apparatus.

In a method for producing image of the present invention, it is preferable that the exposure corrective control means measures the temperature of the photothermographic material immediately before entering the heat developing section and correctively controls the output of the laser exposure based on the measured values. More specifically, the corrective control is preferably effected by the exposure corrective control means so as to lower the laser output as the temperature immediately before entering the heat developing section rises, and so as to raise the laser output as the temperature decreases. It is also preferable to provide a cooling section in the successive stage of the heat developing section, and the exposure corrective control means measures the temperature at the entrance of the cooling section so as to effect the corrective control of the output of the laser exposure according to the obtained value. More specifically, the corrective control is preferably effected by the exposure corrective control means so as to lower the laser output as the temperature at the entrance of the cooling section rises and so as to raise the laser output as the temperature decreases, and so as to raise the laser output as the image density increases and so as to lower the laser output as the image density decreases.

In a method for producing image of the present invention, it is in particular preferable to combine the corrective control such that lowering the laser output as the temperature immediately before entering the heat developing section rises and raising the laser output as the temperature decreases, with the corrective control such that lowering the laser output as the temperature at the entrance of the cooling section rises and raising the laser output as the temperature decreases. It is preferable to further combine a corrective control such that lowering the laser output as the temperature of a stacking zone and such that raising the laser output as the temperature decreases.

The photosensitive silver halide used for the present invention preferably contains an iridium compound selected from the group consisting of hexachloroiridium, hexammineiridium, trioxalatoiridium, hexacyanoiridium and pentachloronitrosyliridium. Amount of addition of the iridium compound is preferably from $1\times10^{-8}$ to $1\times10^{-3}$ mol per one mol of silver halide, and more preferably from $1\times10^{-7}$ to $5\times10^{-4}$ mol.

BRIEF DESCRIPTION OF THE FIGURE

The above and other objects and features of the invention are apparent to those skilled in the art from the following preferred embodiments thereof when considered in conjunction with the accompanied drawing, in which.

Figure 1:
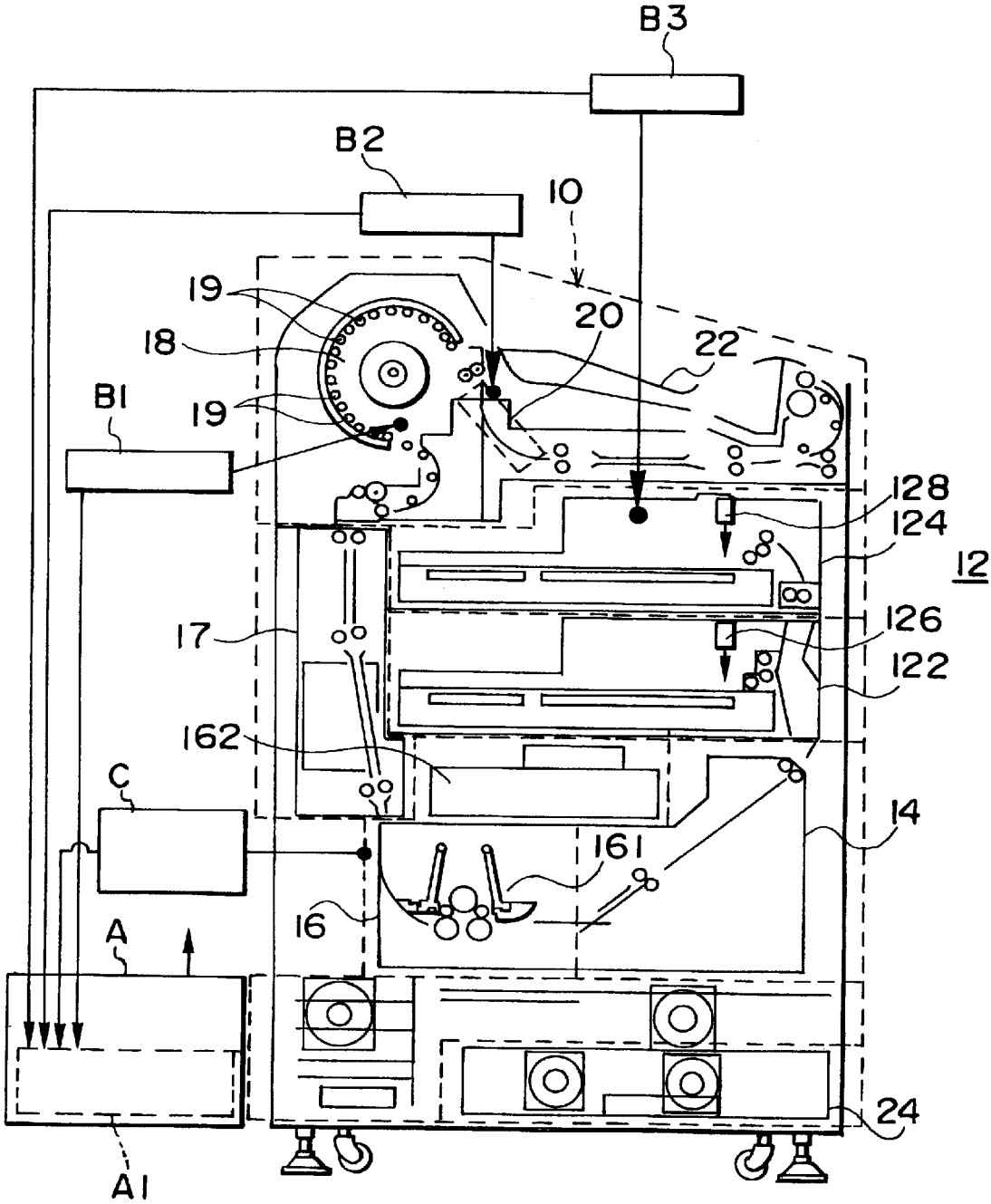
FIG. 1 is a schematic view showing an image producing apparatus for practicing the present invention.

Symbols in the drawings are used as follows: "A" for a control section, A1 for a luminous energy correction circuit, B1, B2 and B3 for temperature sensors, C for a counter for number of copy, 10 for a heat developing apparatus, 12 for a feeding section, 14 for a positioning section, 16 for a recording section, 17 for a conveyance section, 18 for a heat developing section, 19 for heating plates, 20 for a cooling section, 22 for a tray, 24 for a power source section, 122 for a lower sheet loading section, 124 for an upper sheet loading section, 161 for an sub-scanning conveyance means, 162 for an exposure unit, $T_0$ for development proceeding temperature, $t_{10}$ for a start point of the development of photothermographic material (1), $t_{20}$ for a start point of the development of photothermographic material (2), $t_{11}$ for an end point of the development of the photothermographic material, $t_{12}$ for an end point of the development of the photothermographic material at the time of overheating of the cooling section, $t_1$ for a development proceeding time of photothermographic material (1), and $t_2$ for a development proceeding time of photothermographic material (2).

DETAILED EXPLANATION OF THE INVENTION

The method for producing image using a photothermographic material of the present invention will be detailed hereinafter.

The photothermographic material used in the present invention contains at least elsewhere on one plane of the support a photosensitive silver halide, a non-photosensitive organic silver salt, a reducing agent for silver ion and a binder, and characterized in that the photosensitive silver halide further contains an iridium compound.

The photothermographic material used in the present invention may be of sheet type, roll type or so, in which the support may preferably be those described in the paragraph [0134] of JP-A-11-65021 (the code "JP-A" as used herein means an "unexamined published Japanese patent application"). Transparent support is also allowable, which may be colored with a blue dye (for example, Dye-1 described in Example of JP-A-8-240877) or may be colorless. Undercoat techniques for the support are described in JP-A-11-84574 and JP-A-10-186565.

There is no specific limitation on the silver halide available for the photosensitive layer of the photothermographic material, and examples of which include silver chloride, silver chlorobromide, silver bromide, silver iodobromide and silver iodochlorobromide. These may be used individually or in combination of two species or more.

Content of silver halide in the photosensitive layer as expressed in an amount of silver per 1 $m^2$ is preferably 0.03 to 0.6 $g/m^2$, more preferably 0.05 to 0.4 $g/m^2$, and still more preferably 0.1 to 0.4 $g/m^2$.

The photosensitive silver halide is dispersed in a form of particle to provide an emulsion, and is in general further mixed with other components to provide a coating liquid for forming the photosensitive layer of the photothermographic material. Methods for preparing photosensitive silver halide are well known in the art, and, for example, the methods described in Research Disclosure, No. 17029 (June, 1978) and U.S. Pat. No. 3,700,458 may be applied. More specifically, photosensitive silver halide is prepared by adding a silver source compound and a halogen source compound in a solution containing gelatin or other polymer.

For the case that two or more species of the silver halide are used, the halogen composition distribution within the silver halide grain may be uniform, or may change stepwise or continuously.

Examples of the shape of the silver halide grain include cubic, octahedral, tabular, spherical, rod and pebble; among these, cubic being in particular preferred in the present invention. A silver halide grain having rounded corners is also preferably used. While plane indices (Miller indices) of the outer surface plane of a silver halide grain is not particularly limited, it is preferred that [100] plane showing a high spectral sensitization efficiency upon adsorption of the spectral sensitizing dye accounts for a large percentage. The percentage is preferably 50% or above, more preferably 65% or above, still more preferably 80% or above. The percentage of a plane with a Miller index of [100] can be determined by the method described in T. Tani, J. Imaging Sci., 29, 165 (1985), which is based on the plane dependency of adsorption of the sensitizing dye between [111] and [100] planes.

Silver halide grain with a core/shell structure may preferably be used, in which the structure thereof is preferably of double-shelled to quintuple-shelled, and more preferably of double-shelled to quadruple-shelled. It is also preferable to adopt a technique for localizing silver bromide on the surface of silver chloride or silver chlorobromide.

The silver halide grain preferably has a small grain size so as to prevent high white turbidity after image production. Specifically, the grain size is preferably 0.20 $\mu$m or less, more preferably from 0.01 to 0.15 $\mu$m, still more preferably from 0.02 to 0.12 $\mu$m. The term "grain size" as used herein means the diameter of a sphere having a volume equal to that of the silver halide grain for the case that the grain is a so-called normal crystal such as cubic or octahedral shape, or has a spherical or rod shape; and means the diameter of a circle having the same area with the projected area of the major plane of the silver halide grain for the case that the grain has a tabular shape.

When the photosensitive layer of the photothermographic material is formed, a single kind of the silver halide emulsion to be mixed with other components may be used; or two or more kinds of silver halide emulsions differ in the average grain size, crystal habit or chemical sensitization conditions as well as in the halogen composition, may be used in combination. Using two or more kinds of photosensitive silver halide differ in sensitivity allows gradation control. Sensitivity difference among individual emulsions is preferably 0.2 log E or larger. Related technologies are disclosed, for example, in JP-A-57-119341, JP-A-53-

106125, JP-A-47-3929, JP-A-48-55730, JP-A-46-5187, JP-A-50-73627 and JP-A-57-150841.

In the photothermographic material used in the present invention, the photosensitive silver halide contains an iridium compound. Specific examples of the iridium compound include hexachloroiridium, hexammineiridium, trioxalatoiridium, hexacyanoiridium and pentachloronitrosyliridium. Amount of addition of the iridium compound is preferably from $1\times10^{-8}$ to $1\times10^{-3}$ mol per one mol of silver halide, and more preferably from $1\times10^{-7}$ to $5\times10^{-4}$ mol.

These iridium compounds are used in a dissolved form in water or other appropriate solvent. It is also allowable to add an aqueous hydrogen halide solution such as hydrochloric acid, bromic acid or fluoric acid; or alkali halide such as KCl, NaCl, KBr or NaBr to stabilize the solution of the iridium compound. Or the silver halide can also be prepared by adding and dissolving a separate silver halide grain pre-doped with iridium.

The silver halide grain used for the photosensitive layer of the photothermographic material contains a metal of Groups VIII to X in the Periodic Table (expressing Groups I to XVIII), or complexes thereof. Such metal or a center metal of the metal complex is preferably rhodium, rhenium, ruthenium or osmium. These metal or metal complexes may be used individually, and two or more metal complexes having the same metal or different metals may be used in combination. Content of the metal or metal complex is preferably from $1\times10^{-9}$ to $1\times10^{-3}$ mol per one mol of silver in the silver halide. Such metal complex is described in the paragraphs [0018] to [0024] of JP-A-11-65021.

In relation to the silver halide grain used for the photosensitive layer of the photothermographic material, metal atom or metal complex which can further be included (for example, $[Fe(CN)_6]^{4-}$), and applicable methods for desalting or chemical sensitization are disclosed in the paragraphs [0046] to [0050] of JP-A-11-84574, and the paragraphs [0025] to [0031] of JP-A-11-65021.

The non-photosensitive organic silver salt used for the photothermographic material will be described hereinafter. The organic silver salt is an arbitrary organic substance containing a source capable of reducing silver ion, relatively stable against light exposure, but can produce silver image when heated at 80° C. or higher in the presence of light-exposed photocatalyst (e.g. latent image of photosensitive silver halide) and the reducing agent. Specific examples of such non-photosensitive organic silver salts are described in the paragraphs [0048] to [0049] of JP-A-10-62899, and from line 24 on page 18 to line 37 on page 19 of European Laid-Open Patent Publication No. 0803763A1. Among the organic silver salts, preferable is a silver salt of an organic acid, and in particular a silver salt of a long-chain aliphatic carboxylic acid having a carbon number of 10 to 30, and preferably 15 to 28.

Content of the organic silver salt in the photothermographic material, as expressed in a silver amount per 1 $m^2$, is preferably 0.1 to 5 $g/m^2$, and more preferably 1 to 3 $g/m^2$.

The silver salt of the organic acid can be prepared by reacting silver nitrate with a solution or suspension of alkali metal salt of the organic acid. Silver nitrate is generally used in a form of aqueous solution. The reaction can proceed in a batch or continuous manner.

Specific examples of the organic silver salt include silver behenate, silver arachidinate, silver stearate, silver oleate, silver laurate, silver caproate, silver myristate, silver palmitate, silver maleate, silver fumarate, silver tartrate, silver linoleate, silver butyrate and silver camphorate; any one of which being available individually or in combination of two or more selected therefrom.

The alkali metal salt of the organic acid is typified as a sodium salt, potassium salt, lithium salt or the like, and is preferably a sodium salt or potassium salt. The alkali metal salt of the organic acid can be obtained by adding NaOH, KOH or the like to an organic acid, in which it is preferable to limit an amount of use of the alkali metal less than that of the organic acid so that a part of the organic acid will remain unreacted. Amount of the residual organic acid is 3 to 50 mol % relative to 1 mol of the total organic acid, and preferably 3 to 30 mol %. It is also allowable in the preparation to add an excessive amount of alkali and then add acid such as nitric acid or sulfuric acid to neutralize the excessive portion of alkali.

An aqueous solution of silver nitrate, and solution or suspension of an alkali metal salt of an organic acid can be used after being arbitrarily adjusted for their concentrations, pHs and temperatures to control particle size or other characteristics of the organic silver salt to be prepared.

In particular, the aqueous solution of silver nitrate preferably has a concentration of 0.03 to 6.5 mol/l, pH of 2 to 6 and temperature of 0 to 5° C., and more preferably has a concentration of 0.1 to 5 mol/l, pH of 3.5 to 6 and temperature of 5 to 30° C. The solution or suspension of the alkali metal salt of the organic acid is preferably kept by heating at 50° C. or above to ensure a proper fluidity thereof.

In the present invention, it is preferable, in terms of controlling the average particle size of the organic acid silver salt and narrowing the distribution thereof, that an aqueous solution of silver nitrate and a solution or suspension of an alkali metal salt of an organic acid, both solutions being preliminarily prepared, are added concomitantly. In such a case, it is preferable that 30 vol % or more of the total addition is concomitantly added, and more preferably 50 to 75 vol %. When either solution is precedently added, the aqueous solution of silver nitrate in precedence is more preferable. A degree of precedence may preferably be 0 to 50 vol % of the total addition, and more preferably 0 to 25 vol %.

The reaction vessel can be pre-charged with a solvent. While the pre-charged solvent is preferably water, a mixed solvent of a tertiary alcohol and water is also preferably used. It is also preferable as disclosed in JP-A-9-127643 to add the solution while controlling pH or silver potential of the reaction solution during the reaction.

In both cases, temperature of the solution in the reaction vessel is preferably kept at 5 to 75° C., more preferably 5 to 60° C., and most preferably 10 to 50° C. While the temperature is preferably be controlled throughout the entire process of the reaction constant at a certain temperature selected from the above ranges, it is also allowable to control the temperature within the above ranges according to several temperature patterns.

The alkali metal salt of the organic acid is preferably used in a dispersed form into a mixed solvent of water and a tertiary alcohol. Concentration of the alkali metal salt of the organic acid in the mixed solvent is preferably 7 to 50 wt %, more preferably 7 to 45% and still more preferably 10 to 40 wt %. The tertiary alcohol is preferably such that having a carbon number of 4 to 6 so as to ensure homogeneity of the solution. A carbon number exceeding the above range is undesirable since such alcohol is not compatible with water. Among tertiary alcohols with a carbon number of 4 to 6, most preferable is tert-butanol which is most compatible with water. Alcohols other than tertiary alcohol are not preferable since such alcohols have reducing properties and may cause troubles during the preparation of the organic acid silver salt. Amount of use of the tertiary alcohol is preferably 70 vol % or less of the mixed solvent, more preferably 3 to 70%, and more preferably 5 to 50%.

Temperature of the aqueous tertiary alcohol solution containing the alkali metal salt of the organic acid to be charged into the reaction vessel is maintained preferably within a range from 50 to 90° C., more preferably from 60 to 85° C., and most preferably from 65 to 85° C., so as to avoid crystallization or solidification of the alkali metal salt of the organic acid. The temperature is preferably kept from 5 to 15° C. in particular for the case that the aqueous silver nitrate solution and the aqueous tertiary alcohol solution containing the alkali metal salt of the organic acid are added at the same time.

When the aqueous tertiary alcohol solution containing the alkali metal salt of the organic acid is added, temperature difference between the solution and a solution pre-charged in the reaction vessel is preferably controlled within a range from 20 to 85° C., and more preferably from 30 to 80° C. In this case, it is preferable that the aqueous tertiary alcohol solution containing the alkali metal salt of the organic acid is conditioned at a higher temperature. By keeping such temperature difference, deposition rate of microcrystalline alkali metal salt of the organic acid from the warmer aqueous tertiary alcohol solution upon rapid cooling in the reaction vessel and production rate of the organic silver salt through reaction with silver nitrate are properly controlled, thereby to properly control crystal form, crystal size and crystal size distribution of the organic silver salt, which concomitantly result in improved properties of the photothermographic material.

In a process of preparing the organic silver salt, a water-soluble dispersion aid may be added to the aqueous silver nitrate solution, aqueous tertiary alcohol solution containing the alkali metal salt of the organic acid, or the solution pre-charged in the reaction vessel. The dispersion aid may be of any type provided that it can disperse the produced organic acid silver salt. Specific examples thereof complies with those described later in relation to the organic acid silver salt. More specifically, a compound expressed by the general formula (1) of JP-A-62-65035, a water-soluble N-heterocyclic compound having a solubility-expressing group as disclosed in JP-A-62-150240, an inorganic peroxide as disclosed in JP-A-50-101019, a sulfur compound as disclosed in JP-A-51-78319, a disulfide compound as disclosed in JP-A-57-643 and hydrogen peroxide.

While there is no special limitation on particle shape of the organic silver salt used for the photothermographic material, scaly organic silver salt is preferable in the present invention. Here the scaly organic silver salt in the present invention is defined as follows. The particle of the organic silver salt is microscopically observed and the shape thereof is approximated as a rectangular parallelepiped. Edges of the rectangular parallelepiped are denoted as "a", "b" and "c" in the order from the shortest length, then x=b/a is calculated for approx. 200 particles and obtain an average "x(average)" thereof, in which those satisfying a relation of x(average) $\geqq 1.5$ are defined as scaly, preferably satisfying $30 \geqq x$ (average) $\geqq 1.5$, and more preferably $20 \geqq x(\text{average}) \geqq 2.0$. For reference, acicular form is defined for those satisfying a relation of $1 \leqq x(\text{average}) < 1.5$.

As for a scaly particle, "a" can be assumed as a thickness of a tabular particle having a major plane surrounded by edges "b" and "c". An average of "a" is preferably 0.01 to 0.23 μm, and more preferably 0.1 to 0.20 μm. An average of "c/b" is preferably 1 to 6, more preferably 1.05 to 4, still more preferably 1.1 to 3, and most preferably 1.1 to 2.

Particle size distribution of the organic silver salt is preferably of monodisperse. The term "monodisperse" as used herein means that the percentage of the value obtained by dividing the standard deviation of the length of the short axis or long axis by the length of the short axis or long axis, respectively, is preferably 100% or less, more preferably 80% or less, still more preferably 50% or less. Another method for determining the monodispersibility is such that obtaining the standard deviation of volume weighted mean diameter of the organic silver salt. The percentage (coefficient of variation) of the value obtained by dividing the standard deviation by the volume weighted mean diameter is preferably 100% or less, more preferably 80% or less, still more preferably 50% or less. The measurement procedures include irradiating laser light to the organic silver salt dispersed in a solution; deriving an autocorrelation function with respect to the time-dependent fluctuation in the scattered light intensity; and thereby obtaining grain size (volume weighted mean diameter).

In a process of producing the organic silver salt, it is preferable to provide a desalting and dewatering step after the production of the silver salt. There is no specific limitation on the method therefor, and any of well-known practical means is applicable. Known filtration methods such as centrifugal filtration, suction filtration, ultrafiltration and flocculation washing based on coagulation; and supernatant removal after centrifugal separating sedimentation are preferably used. The desalting and dewatering may be performed once or repeated plural times. Addition and removal of water may be effected continuously or independently. The desalting and dewatering is effected so as to preferably obtain a conductivity of the finally recovered water of approx. 300 μS/cm or lower, more preferably 100 μS/cm or lower, and most preferably 60 μS/cm or lower. While the lower limit of the conductivity is not specifically limited, it is 5 μS/cm or around in general.

The organic silver salt is preferably in a form of fine water-base dispersion in terms of improving surface property of the photothermographic material. An average grain size of the fine water-base dispersion of the organic silver salt is preferably within a range from 0.05 to 10.0 μm, more preferably 0.1 to 5.0 μm, and still more preferably 0.1 to 2.0 μm. The grain size (volume weighted mean diameter) can be calculated based on an autocorrelation function with respect to the time-dependent fluctuation in the intensity of the scattered laser light irradiated to the grain dispersed in the liquid.

While there is no specific limitation on the ratio of the organic silver salt and water in the fine water-base dispersion, water preferably accounts for 5 to 50 wt % of the organic silver salt, and more preferably 10 to 30 wt %. Although the dispersion medium preferably consists of water only, the medium may contain organic solvent within a content of 20 wt %. Using a dispersion aid described later is preferable provided that it is used in a minimum amount within a range suitable for minimizing the grain size, and preferable range thereof is 1 to 30 wt % of the organic silver salt, and more preferably 3 to 15 wt %.

Specific examples of the dispersion aid for the organic silver salt include synthetic anionic polymers such as polyacrylic acid, copolymers of acrylic acid, maleic acid copolymers, maleic monoester copolymers and acryloylmethylpropanesulfonic acid copolymers; semi-synthetic anionic polymers such as carboxymethylated starch and carboxymethyl cellulose; anionic polymers such as alginic acid and pectic acid; anionic surfactants disclosed in JP-A-52-92716 and WO 88/04794; compound disclosed in JP-A-9-179243; known anionic, nonionic and cationic surfactants; other known polymers such as polyvinyl alcohol, polyvinylpyrrolidone, carboxymethyl cellulose, hydroxypropyl cellulose, and hydroxypropylmethyl cellulose; and naturally occurring polymers such as gelatin and the like.

The dispersion aid is generally mixed with the organic silver salt in a form of powder or wet cake before the dispersing operation, and fed as contained in a slurry into a dispersion apparatus, whereas the dispersion aid may also be included in the powder or wet cake by heat treatment or solvent treatment of the dispersion aid premixed with the organic silver salt.

It is preferable that the fine water-base dispersion of the organic silver salt substantially contains no photosensitive silver salt, the content thereof being 0.1 mol % or less of the non-photosensitive organic silver salt contained therein, without any intentional addition of the photosensitive silver salt. Coexistence of the photosensitive silver salt during the fine dispersion of the organic silver salt may increase fog and significantly lower the sensitivity.

The fine water-base dispersion of the organic silver salt is prepared by converting a water-base dispersion into a high-speed flow under a high pressure, and then dropping the pressure thereof to effect re-dispersion. Or it is prepared by mechanical dispersion in the presence of a dispersion aid using a known pulverizing means (e.g. high-speed mixer, homogenizer, high-speed impact mill, banbury mixer, homomixer, kneader, ball mill, vibration ball mill, epicyclic ball mill, attritor, sand mill, bead mill, colloid mill, jet mill, roller mill, trommel and high-speed stone mill). To obtain a fine water-base dispersion of the organic silver salt with a high S/N ratio, small grain size and no coagulation, it is preferable in the present invention to apply a large force to the particles of the organic silver salt as an image forming medium within a range such that not causing fracture or excessive temperature rise of the particles. Thus preferable is a dispersion method such that converting a water-base dispersion comprising the organic silver salt and aqueous dispersion aid solution into a high-speed flow, and then dropping the pressure thereof. Besides such mechanical dispersing operation, the organic silver salt can preliminarily be dispersed into solvent by pH control, and then can thoroughly be dispersed by altering pH under the presence of the dispersion aid. The solvent for the preliminary dispersion may be an organic solvent, which is generally removed after the thorough dispersion.

Dispersion apparatuses and technologies available for implementing such re-dispersion are detailed, for example, in "Bunsankei Reoroji to Bunsanka Gijutsu (Dispersed System Rheology and Dispersion Technology)", by Toshio Kajiuchi and Hiroki Usui, 1991, issued by Sinzansha Shuppan, p.357–403; "Kagaku Kogaku no Sinpo (Advances in Chemical Engineering) Vol.24", ed. Tokai Section, The Society of Chemical Engineers, 1990, issued by Maki Shoten, p.184–185; JP-A-59-49832; U.S. Pat. No. 4,533,254; JP-A-8-137044; JP-A-8-238848; JP-A-2-261525; and JP-A-1-94933. The re-dispersion in the present invention is preferably effected by feeding the water-base dispersion containing the organic silver salt into a piping while being pressurized with a high-pressure pump or the like, allowing the dispersion to pass through a narrow slit, and then causing an abrupt pressure drop to the dispersion thereby completing a fine dispersion.

As for a high-pressure homogenizer, an uniform and effective dispersion is generally considered to be effected, without altering neither (a) "shearing force" generated when disper soid passes through a narrow gap (approx. 75 to 350 $\mu$m) under a high pressure and at a high speed, nor (b) "cavitation force" generated by liquid-liquid collision or collision against a wall in a pressurized narrow space, by enhancing the cavitation force by the succeeding pressure drop. Galling homogenizer has long been known as such kind of dispersion apparatus, in which a pressure-fed solution to be dispersed is converted into a high-speed flow at a narrow gap on a cylinder surface, then rushed to be collided with the peripheral wall, thereby allowing emulsification or dispersion assisted by the impact force. The liquid-liquid collision can be effected, for example, in a Y-type chamber of a microfluidizer and a spherical chamber using a ball type check valve as disclosed in JP-A-8-103642 described later, and the liquid-wall collision can be effected, for example, in a Z-type chamber of a microfluidizer. Operating pressure is, in general, selected in a range from 100 to 600 kg/cm$^2$, and flow rate in a range from several to 30 m/second. There is also proposed an apparatus such that having a sawtoothed high flow rate portion to increase the number of collision for a higher dispersion efficiency. Typical examples of such apparatuses include galling homogenizer, microfluidizer manufactured by Microfluidex International Corporation or Mizuho Kogyo K.K., and Nanomizer manufactured by Tokushu Kika Kogyo Co., Ltd. Such apparatuses are also disclosed in JP-A-8-238848, JP-A-8-103642 and U.S. Pat. No. 4,533,254.

The organic silver salt can be dispersed into a desired grain size by properly adjusting the flow rate, pressure difference at the time of the pressure drop and the number of repetition of the process. Taking photographic properties and the grain size into account, the flow rate is preferably from 200 to 600 m/sec, more preferably from 300 to 600 m/sec, and the pressure difference at the pressure drop is preferably from 900 to 3000 kg/cm$^2$, and more preferably from 1500 to 3000 kg/cm$^2$. The number of repetition of the process is selectable as required. While this is generally selected as once to as much as 10 times, once to as much as 3 times is preferred from the viewpoint of productivity. Raising the temperature of such water-base dispersion under high pressure is undesirable from the viewpoint of dispersibility and photographic properties, that is, raising the temperature above 90° C. tends to result in increased grain size and increased fogging. It is thus preferable to provide a cooling step before the conversion into the high-pressure, high-speed flow and/or after the pressure drop, to maintain the temperature of the water-base dispersion within a range from 5 to 90° C., more preferably from 5 to 80° C., and still more preferably 5 to 65° C. Providing such cooling step is particularly effective when the dispersion is proceeded under the pressure as high as 1500 to 3000 kg/cm$^2$. A cooler is properly selected, depending on the required capacity of heat exchange, from those being equipped with a double pipe or triple pipe as combined with a static mixer; shell-and-tube heat exchanger; and coiled heat exchanger. The diameter, wall thickness and material of the pipe are properly be selected, considering the operating pressure, so as to improve the efficiency of the heat exchange. Coolants available for the cooler is selectable, depending on the required amount of heat exchange, from well water at 20° C.; cold water at 5 to 10° C. fed from a chiller; and, as requested, ethylene glycol/water at −30° C.

The produced fine water-base dispersion of the organic silver salt can be stored under stirring in order to prevent precipitation of the grain during storage, or stored in a highly viscous state by producing hydrophilic colloid (e.g. jelly state formed with gelatin). Further, it may be added with a preservative in order to prevent germ proliferation during the storage.

The photothermographic material contains a reducing agent for reducing a silver ion derived from the organic silver salt. The reducing agent is an arbitrary substance capable of reducing silver ion into metal silver, and is preferably an organic substance. Specific examples of the reducing agent are disclosed in the paragraphs [0043] to [0045] of JP-A-11-65021 and line 34 on page 7 to line 12 on page 18 of European Laid-Open Patent Publication No. 0803764A1. Bisphenol reducing agents are in particular preferable for the present invention, which is typified by 1,1-bis(2-hydroxy-3,5-dimethylphenyl)-3,5,5-trimethylhexane. Amount of addition of the reducing agent is preferably 0.01 to 5.0 g/m$^2$, and more preferably 0.1 to 3.0 g/m$^2$.

The reducing agent used for the photothermographic material is preferably added in a form of a solid microparticle dispersion. Dispersion of the solid microparticle is effected using a known pulverizing means (e.g. ball mill, vibrating ball mill, sand mill, colloid mill, jet mill and roller mill). A dispersion aid may be available for dispersing the solid microparticle.

The photothermographic material contains a binder. Amount of the binder in the photosensitive layer is preferably 0.2 to 30 g/m$^2$, and more preferably 1 to 15 g/m$^2$.

In the present invention, preferably used are hydrophobic polymers such as acrylic resin, polyester resin, rubber-base resin (for example, SBR resin), polyurethane resin, vinyl chloride resin, vinyl acetate resin, vinylidene chloride resin and polyolefin resin. The polymer may be a straight-chained polymer, a branched polymer or a cross-linked polymer. The polymer may be a so-called homopolymer consisting of a single kind of monomer or may be a copolymer consisting of two or more kinds of monomers. Both of random copolymer and block copolymer are allowable as the copolymer. The polymer preferably has a number average molecular weight of from 5,000 to 1,000,000, and more preferably from 10,000 to 200,000. Too small molecular weight will result in poor mechanical strength of the emulsion layer, whereas too large in undesirable film-forming property.

Polymer latex is also preferable as a binder used for the photothermographic material. Preferable examples of the polymer latex are listed below, in which polymers are expressed with source monomers, and numerals in the parentheses denote contents in wt % and the molecular weights represent number average molecular weights:

P-1; latex expressed as -MMA(70)-EA(27)-MAA(3)- (M.W. 37,000),

P-2; latex expressed as -MMA(70)-2EHA(20)-St(5)-AA(5)- (M.W. 40,000),

P-3; latex expressed as -St(50)-Bu(47)-MAA(3)- (M.W. 45,000),

P-4; latex expressed as -St(68)-Bu(29)-AA(3)- (M.W. 60,000),

P-5; latex expressed as -St(70)-Bu(27)-IA(3)- (MW. 120, 000),

P-6; latex expressed as -St(75)-Bu(24)-AA(1)- (M.W. 108, 000),

P-7; latex expressed as -St(60)-Bu(35)-DVB(3)-MAA(2)- (M.W. 150,000),

P-8; latex expressed as -St(70)-Bu(25)-DVB(2)-AA(3)- (M.W. 280,000),

P-9; latex expressed as -VC(50)-MMA(20)-EA(20)-AN(5)-AA(5)- (M.W. 80,000),

P-10; latex expressed as -VDC(85)-MMA(5)-EA(5)-MAA (5)- (M.W. 67,000),

P-11; latex expressed as -Et(90)-MAA(10)- (M.W. 12,000),

P-12; latexexpressedas-St(70)-2EHA(27)-AA(3)- (M.W. 130,000), and

P-13; latex expressed as -MMA(63)-EA(35)-AA(2)- (M.W. 33,000).

The abbreviations in the above structures correspond with monomers as follows: MMA=methyl methacrylate, EA=ethyl acrylate, MAA=methacrylic acid, 2EHA=2-ethylhexyl acrylate, St=styrene, Bu=butadiene, AA=acrylic acid, DVB=divinylbenzene, VC=vinyl chloride, AN=acrylonitrile, VDC=vinylidene chloride, Et=ethylene, and IA=itaconic acid.

Such polymers are also commercially available, which include acrylic resins such as CEBIAN A-4635, 46583 and 4601 (all produced by Dicel Kagaku Kogyo K.K.) and Nipol Lx811, 814, 821, 820 and 857 (all produced by Nippon Zeon K.K.); polyester resins such as FINETEX ES650, 611, 675 and 850 (all produced by Dai-Nippon Ink & Chemicals, Inc.), WD-size and WMS (both produced by Eastman Chemical); polyurethane resins such as HYDRAN AP10, 20, 30 and 40 (all produced by Dai-Nippon Ink & Chemicals, Inc.); rubber-based resins such as LACSTAR 7310K, 3307B, 4700H and 7132C (all produced by Dai-Nippon Ink & Chemicals, Inc.), Nipol Lx4l6, 410, 438C and 2507 (all produced by Nippon Zeon K.K.); vinyl chloride resins such as G351 and G576 (both produced by Nippon Zeon K.K.); vinylidene chloride resins such as L502 and L513 (both produced by Asahi Chemical Industry Co., Ltd.); and olefin resins such as CHEMIPEARL S120 and SA100 (both produced by Mitsui Chemical Co., Ltd.).

These polymer latexes may be used individually or, as required, as a blend of two or more selected therefrom.

The polymer latex preferably used as a binder for the photothermographic material is such that being soluble or dispersible in an aqueous solvent (dispersion medium) and having an equilibrium moisture content at 25° C., 60%RH of 2 wt % or less, more preferably 0.01 to 1.5 wt %, and still more preferably 0.02 to 1 wt %. It is preferable that such polymer latex additionally has an ion conductivity of 2.5 mS/cm or below. Such polymer latex can be obtained by purifying a synthesized polymer using a separation functional membrane.

A water-base solvent capable of dispersing the polymer latex refers to water or water mixed with 70 wt % or less thereof of a water-miscible organic solvent. Examples of the water-miscible solvent include alcohols such as methanol, ethanol and propanol; Cellosolves such as Methyl Cellosolve, Ethyl Cellosolve and Butyl Cellosolve; ethyl acetate and dimethylformamide.

Possible dispersion forms of the polymer latex include an emulsified dispersion, latex in which micro particles of solid polymer are dispersed, and such that polymer molecules are dispersed in a molecular state or form micells. While any of which is allowable, the latex is in particular preferable.

"The equilibrium moisture content at 25° C., 60%RH" can be expressed by an equation such as equilibrium moisture content at 25° C., 60%RH=[(W1−W0)/W0]×100 (wt %) where, W1 represents polymer weight under humidity conditioning equilibrium in an environment of 25° C. and 60%RH, and WO represents polymer weight under bone dry equilibrium.

A latex of styrene-butadiene copolymer is in particular preferable as the polymer latex used as a binder for the photothermographic material. A weight ratio of styrene monomer unit and butadiene monomer unit in the styrene-butadiene copolymer is preferably 40:60 to 95:5. The styrene monomer unit and butadiene monomer unit in together preferably account for 60 to 99 wt % of the copolymer. A preferable range for the molecular weight thereof is the same as described previously. Especially preferable latexes of the styrene-butadiene copolymer include P-3 to P-8 as listed above, and commercially available LACSTAR-3307B, 7132C and Nipol Lx416.

The photosensitive layer of the photothermographic material is preferably formed by coating on the support a coating liquid prepared by mixing a silver halide, organic silver salt, reducing agent for silver ion, and binder. A mixing ratio of the silver halide and organic silver salt may be selected by purposes, where the silver halide per 1 mol of the organic silver salt is preferably 0.01 to 0.5 mol, more preferably from 0.02 to 0.3 mol, and still more preferably from 0.03 to 0.25 mol. It is preferable from the viewpoint of controlling photographic properties to respectively use two or more kinds of the silver halide emulsions prepared as described above and the fine water-base dispersions of the organic silver salt. Amount of the reducing agent for silver ion is preferably 5 to 50 mol % of silver, and more preferably 10 to 40 mol %. Amount of the binder is preferably 5 to 400 times by weight of silver halide, more preferably 10 to 200 times by weight; and is expressed by a weight ratio with respect to the organic silver salt (=binder/organic silver salt) as 1/10 to 10/1, and more preferably 1/5 to 4/1.

A solvent (herein for simplicity, the solvent and dispersoid are inclusively termed as "solvent") is preferably used for a coating liquid for forming the photosensitive layer. The solvent is preferably water or a water-containing mixed solvent, where a water content of the mixed solvent is preferably 30 wt % or above, and more preferably 50 wt %, and still more preferably 70 wt %. Possible component of the mixed solvent other than water may be an arbitrary water-miscible organic solvent such as methanol, ethanol, isopropanol, Methyl Cellosolve, Ethyl Cellosolve, dimethylformamide or ethyl acetate, which may be used individually or in combination of two or more selected therefrom. Preferable examples of the solvent composition include pure water, water/methanol=90/10, water/methanol=70/30, water/methanol/dimethylformamide=80/15/5, water/methanol/Ethyl Cellosolve=85/10/5 and water/methanol/isopropanol=85/10/5 (the numerals are in wt %).

Preparation temperature of the coating liquid for the photosensitive layer is preferably 30 to 65° C., more preferably 35 to 60° C., and still more preferably 35 to 55° C.

While the individual components can be added in an arbitrary order in a process of preparing the coating liquid for the photosensitive layer, it is preferable that the reducing agent and organic silver salt are preliminarily mixed with each other before the polymer latex is added.

There is no specific limitation on the method nor conditions for mixing the silver halide emulsion and fine water-base dispersion of the organic silver salt, both of which being separately prepared, so far as a sufficient benefit of the present invention is affordable. That is, the separately prepared matters can be mixed by using a high-speed stirrer, ball mill, sand mill, colloid mill, vibrating mill, homogenizer or the like.

A preferable timing for adding the silver halide emulsion to the coating liquid for the photosensitive layer resides in a period from 180 minutes before to immediately before the coating, and more preferably from 60 minutes before to 10 seconds before. There is no specific limitation on method or conditions for the mixing provided that sufficient effects of the present invention will be obtained. Specific examples of the method include such that using a tank devised so that an average retention time estimated based on the addition flow rate and feed volume to a coater is adjusted to a desired value; and such that using a static mixer described in Chapter 8 of "Ekitai Kongo Gij utsu (Liquid Mixing Technology) " by N. Harnby, M. F. Edwards, and A. W. Nienow, translated by Koji Takahashi, published by Nikkan Kogyo Shinbun-sha (1989).

The coating liquid for the photosensitive layer is preferably a so-called thixotropic fluid. Thixotropy refers to a property such that the viscosity decreases as the shearing velocity increases. While any type of apparatus is available for viscosity measurement, preferable measurement can be performed at 25° C. using RFS Fluid Spectrometer manufactured by Rheometric Far East Inc. In the present invention, the viscosity of the coating liquid for the photosensitive layer under a shearing velocity of 0.1 $S^{-1}$ is preferably 400 to 100,000 mPa·s, and more preferably 500 to 20,000 mPa·s. Such viscosity under a shearing velocity of 1000 $S^{-1}$ is preferably 1 to 200 mPa·s, and more preferably 5 to 80 mPa·s.

There are known various system exerting thixotropy and can be found in "Koza-Reoroji (Rheology Course)" edited by Kobunshi Kanko-kai, and "Kobunshi Ratekkusu (Polymer Latex)" collaborated by Muroi and Morino. The fluid necessarily contains a large amount of solid microparticles to exert thixotropy. Thixotropy can advantageously be enhanced by including a thickening linear polymer, increasing an aspect ratio of solid particle with an anisotropic shape, or using an alkali thickener or surfactant.

The photosensitive layer of the photothermographic material can optionally be added with a hydrophilic polymer such as gelatin, polyvinyl alcohol, methyl cellulose, or hydroxypropyl cellulose. Amount of addition of these hydrophilic polymers is preferably 30 wt % or less of the binder in the photosensitive layer, and preferably 20 wt % or less. The photosensitive layer may also be added with a cross-linking agent for crosslinking or a surfactant for improving coating property.

The photosensitive layer of the photothermographic material may contain a sensitizing dye. The sensitizing dye may arbitrarily be selected from those capable of spectrally sensitizing the silver halide particles at a desired wavelength region by adhering thereon, and having a spectral sensitivity suitable for spectral characteristics of an exposure light source. Sensitizing dyes and methods for adding thereof are described in the paragraphs [0103] to [0109] of JP-A-11-65021, expressed by the general formula (II) of JP-A-10-186572, and described from line 38 on page 19 to line 35 on page 20 of European Laid-Open Patent Publication No. 0803764A1. The sensitizing dye is preferably added into the silver halide emulsion, and the timing of the addition is preferably in a period from the completion of the desalting to the start of the coating, and more preferably from the desalting to the start of the chemical ripening.

The photosensitive layer of the photothermographic material may be added with an antifoggant, stabilizer or stabilizer precursor. Specific examples thereof include those described in the paragraph [0070] of JP-A-10-62899 and from line 57 on page 20 to line 7 on page 21 of European Laid-Open Patent Publication No. 0803764A1. The antifoggant preferably used in the present invention is an organic halide, specific example of which is described in the paragraphs [0111] to [0114] of JP-A-11-65021, and those expressed by the general formula (II) in JP-A-10-339934. In particular, tribromomethylnaphthylsulfone, tribromomethylphenylsulfone, tribromomethyl[4-(2,4,6-trimethylphenylsulfonyl)phenyl]sulfone or the like is preferable.

The antifoggant used in the present invention may preferably be added in a form of solid microparticle dispersion. Dispersion of the solid microparticle is effected using a known pulverizing means (e.g. ball mill, vibrating ball mill, sand mill, colloid mill, jet mill and roller mill). It is also allowable to use, as a dispersion aid, an anionic surfactant such as sodium triisopropylnaphthalenesulfonate (a mixture of isomers differed in the sites of substitution by three isopropyl groups).

It is also allowable to add an azolium salt for preventing fog. Examples of azolium salt include those expressed by the general formula (XI) in JP-A-59-193447, those disclosed in JP-B-55-12581 (the code "JP-B" as used herein means an "examined Japanese Patent Publication"), and those expressed by the general formula (II) in JP-A-60-153039. Although the azolium salt may be added to any portion of the photothermographic material, addition to the photosensitive layer is preferable. The azolium salt may be added at any step from the preparation of the organic silver salt to the preparation of the coating liquid, where addition in a period following the preparation of the organic silver salt and immediately before the coating is preferable. The azolium salt may be added in any form of powder, solution or solid microparticle dispersion. It is also allowable to add them in a form of mixed solution containing other additives such as a sensitizing dye, reducing agent and color toner. Amount of addition of the azolium salt can arbitrarily be selected, where a preferable range being from $1\times10^{-6}$ to 2 mol, inclusive, per one mol of silver, and more preferably from $1\times10^{-3}$ to 0.5 mol, inclusive.

The photosensitive layer of the photothermographic material may contain mercapto compound, disulfide compound or thione compound so as to control the development by retarding or accelerating thereof, to improve the spectral sensitization efficiency, or to improve the storage stability before and after the development. Examples of such compounds are disclosed in the paragraphs [0067] to [0069] of JP-A-10-62899, expressed by the general formula (I) and specifically described in the paragraphs [0033] to [0052] of JP-A-10-186572, and described in lines 36 to 56 on page 20 of European Laid-Open Patent Publication No. 0803764A1. Among these, mercapto-substituted heteroaromatic compound is particularly preferable.

The photosensitive layer of the photothermographic material is preferably added with a color toner. Specific examples of the color toner are described in the paragraphs [0054] to [0055] of JP-A-10-62899, and in lines 23 to 48 on page 21 of European Laid-Open Patent Publication No. 0803764A1. Examples of the color toner include phthalazinone; phthalazinone metal salts; or the derivatives; phthalazinone derivatives such as 4-(1-naphthyl)phthalazinone, 6-chlorophthalazinone, 5,7-dimethoxyphthalazinone and 2,3-dihydro-1,4-phthalazinedione; combinations of phthalazinone and phthalic acid derivatives (e.g. phthalic acid, 4-methyltphthalic acid, 4-nitrophthalic acid and tetrachloro phthalic anhydride); phthalazine; phthalazine metal salts; phthalazine derivatives such as 4-(1-naphthyl) phthalazine, 6-isopropylphthalazine, 6-tert-butylphthalazine, 6-chlorophthalazine, 5,7-dimethoxyphthalazine, and 2,3-dihydrophthalazine); and combinations of phthalazine and phthalic acid derivatives (e.g. phthalic acid, 4-methylphthalic acid, 4-nitrophthalic acid tetrachlorophthalic anhydride) ; among these the combinations of phthalazines and phthalic acid derivatives being in particular preferable.

Examples of plasticizer and lubricant applicable to the photosensitive layer of the photothermographic material are found in the paragraph [0117] of JP-A-11-65021, examples of ultrahigh contrast agent for forming a ultrahigh contrast image are found in the paragraph [0118] of the same publication, and examples of contrast accelerator are found in the paragraph [0102] of the same publication.

The photosensitive layer of the photothermographic material may contain a dye or pigment of various types so as to improve the color tone, to prevent interference fringes, or to prevent the irradiation. This is described in detail in WO 98/36322. Examples of dyes and pigments suitable for the photosensitive layer include anthraquinone dye, azomethine dye, indoaniline dye, azo dye, anthraquinone-base indanthrone dye (for example, C.I. Pigment Blue 60), phthalocyanine dye (for example, copper phthalocyanine such as C.I. Pigment Blue 15, and metal-free phthalocyanine such as C.I. Pigment Blue 16), dying lake pigment-base triarylcarbonyl pigment, indigo, and inorganic pigment (for example, ultramarine blue, cobalt blue). The dye or pigment may be added in any form of solution, emulsified product, solid microparticle dispersion, or may be added in the state mordanted with a polymer mordant. Amount of use of such compounds may be determined according to desired absorbance, and, in general, the compounds are preferably used in an amount of from $1\times10^{-6}$ to 1 g per 1 $m^2$ of the photothermographic material.

The photothermographic material generally has, in addition to the photosensitive layer, the non-photosensitive layer. The non-photosensitive layer can be classified by the arrangement thereof into (1) a protective layer provided on the photosensitive layer (on the side afar from the support), (2) an intermediate layer provided between a plurality of the photosensitive layers or between the photosensitive layer and the protective layer, (3) an undercoat layer provided between the photosensitive layer and the support, and (4) a back layer provided on the opposite side of the photosensitive layer. The filter layer is provided to photothermographic material as a layer classified as (1) or (2), whereas the antihalation layer is provided thereto as a layer classified as (3) or (4).

Also the heat-developable photographic emulsion used in the present invention may have, in addition to the photosensitive layer, one or more non-photosensitive layers.

In the case of a multi-dye multi-color photothermographic material, it is allowable to provide a combination of a photosensitive layer and a protective layer for each color; or all components may be contained in a single layer as described in U.S. Pat. No. 4,708,928; or functional or a non-functional barrier layer is interposed between individual photosensitive layers so as to discriminate each color as described in U.S. Pat. No. 4,460,681.

The photothermographic material used in the present invention may have a surface protective layer for preventing adhesion of the photosensitive layer. Descriptions on the surface protective layer are found in the paragraphs [0119] to [0120] of JP-A-11-65021. While gelatin is preferably used as a binder for the surface protective layer, also polyvinyl alcohol (PVA) is successfully used. Examples of PVA include fully saponified PVA-105 [PVA content≧94.0 wt %, saponification ratio=98.5+0.5 mol %, sodium acetate content≦1.5 wt %, volatile matter content≦5.0 wt %, viscosity (4 wt %, 20° C.)=5.6±0.4 cps]; partially saponified PVA-205 [PVA content≧94.0 wt %, saponification ratio=88.0±1.5 mol %, sodium acetate content=1.0 wt %, volatile matter content=5.0 wt %, viscosity (4 wt %, 20° C.)=5.0±0.4 cps]; and modified polyvinyl alcohol named MP-102, MP-202, MP-203, R-1130 and R-2105 (all of which being product names by Kuraray Co., Ltd.). Amount of coating of polyvinyl alcohol (per 1 $m^2$ of the support) per one protective layer is preferably 0.3 to 4.0 $g/m^2$, and more preferably 0.3 to 2.0 $g/m^2$.

The photothermographic material used in the present invention may have an antihalation layer more distant from a light source than the photosensitive layer is. Descriptions on the antihalation layer are found in the paragraphs [0123] to [0124] of JP-A-11-65021.

It is preferable in the present invention to add a fading dye and basic precursor to the non-photosensitive layer of the photothermographic material, and allow the non-photosensitive layer to function as a filter layer or antihalation layer. The fading dye and basic precursor are preferably added to the same non-photosensitive layer, whereas adding separately into the two adjacent non-photosensitive layers is also allowable. A barrier layer can be provided between two non-photosensitive layers.

The fading dye may be added to the non-photosensitive layer in any form of solution, emulsified product or solid microparticle dispersion or may be added by adding polymer immersed material to the coating liquid for the non-photosensitive layer. It is also allowable to add the dye to the non-photosensitive layer using a polymer mordant. These methods of addition are the same as the general methods adding the dye to the photothermographic material. Latex used for the polymer immersed material is described in U.S. Pat. No. 4,199,363, German Laid-Open Patent Publication Nos. 25,141,274 and 2,541,230, European Laid-Open Patent Publication No. 029,104 and JP-B-53-41091. An emulsifying method in which the dye is added into the polymer solubilized solution is disclosed in WO 88/00723.

Amount of addition of the fading dye is determined according to applications of the dye. In general, the fading dye is used in an amount affording an optical density (absorbance) measured at a target wavelength exceeding 0.1. The optical density is preferably 0.2 to 2. Amount of use of the dye to afford such optical density is approx. 0.001 to 1 $g/m^2$ in general, more preferably approx. 0.005 to 0.8 $g/m^2$, and still more preferably approx. 0.01 to 0.2 $g/m^2$. Such fading of the dye makes the optical density suppressed to 0.1 or below. Two or more fading dyes may be used together for the heat-fading recording material or photothermographic material. Similarly, two or more basic precursors may be used together.

The photothermographic material of the present invention preferably has on one side of the support the photosensitive layer and on the opposite side the back layer. Descriptions on the back layer applicable to the present invention are found in the paragraphs [0128] to [0130] of JP-A-11-65021.

The photothermographic material preferably contains a matting agent to improve conveyance property. The matting agent is preferably added to an outermost layer or a layer functions as the outermost layer of photothermographic material, or to a layer provided near the outer surface thereof, and in particular to a layer functions as a so-called protective layer. Descriptions on the matting agent are found in the paragraphs [0126] to [0127] of JP-A-11-65021. Amount of addition of the matting agent per 1 $m^2$ of the photothermographic material is preferably 1 to 400 $mg/m^2$, and more preferably 5 to 300 $mg/m^2$.

While there is no special limitation on the degree of matting so long as stardust failure does not occur, the Beck smoothness falls preferably within a range from 50 to 10,000 seconds, and more preferably 80 to 10,000 seconds. The degree of matting of the back layer as expressed by Beck smoothness is preferably 10 to 1,200 seconds, more preferably 30 to 700 seconds, and still more preferably 50 to 500 seconds.

In the present invention, each of layers such as the photosensitive layer, protective layer and back layer may contain a film hardening agent. Examples and various method of use of the film hardening agent are described in "The Theory of the Photographic Process 4th Edition" by T. H. James, published by Macmillan Publishing Co., Inc. (1977), pages 77 to 87, and preferably used are polyvalent metal ion described on page 78 of this publication; polyisocyanates described in U.S. Pat. No. 4,281,060 and JP-A-6-208193; epoxy compounds described, for example, in U.S. Pat. No. 4,791,042; and vinyl sulfone compounds described, for example, in JP-A-62-89048.

Specifically, the film hardening agent is added in a form of solution, and preferable timing for adding thereof to the coating liquid for the protective layer resides in a period from 180 minutes before to immediately before the coating, and more preferably from 60 minutes before to 10 seconds before. There is no specific limitation on methods or conditions for the mixing provided that sufficient effects of the present invention will be afforded. Specific examples of the method include such that using a tank devised so that an average retention time estimated based on the addition flow rate and feed volume to a coater is adjusted to desired values; and such that using a static mixer described in Chapter 8 of "Ekitai Kongo Gijutsu (Liquid Mixing Technology)" by N. Harnby, M. F. Edwards, and A. W. Nienow, translated by Koji Takahashi, published by Nikkan Kogyo Shinbun-sha (1989).

Surfactants applicable to the present invention are described in the paragraph [0132] of JP-A-11-65021, solvents in the paragraph [0133] of the same publication, antistatic or conductive layer in the paragraph [0135] of the same publication, and methods for obtaining a color image in the paragraph [0136] of the same publication.

An antioxidant, stabilizer, plasticizer, ultraviolet absorbing agent or coating aid may be added either to the photosensitive layer or non-photosensitive layer of the photothermographic material, which can be referred to WO 98/36322, EP803764A1, JP-A-10-186567 and JP-A-10-186568.

In the present invention, the individual layers may be coated or formed by any process, which is typified by a variety of coating processes such as extrusion coating, slide coating, curtain coating, dip coating, knife coating, flow coating, and extrusion coating using a specific hopper described in U.S. Pat. No. 2,681,294. In particular, preferable are the extrusion coating and slide coating described together in "Liquid Film Coating" by Stephen F. Kistler and Petert M. Schweizer, published by Chapman and Hall (1997), pages 399 to 536, and the slide coating being more preferable. An exemplary shape of a slide coater used for the slide coating is shown in FIG. 11b.1 on page 427 in the above publication. It is also allowable to simultaneously coat two or more layers as required according to the methods described in pages 399 to 536 in the above publication, or the method described in U.S. Pat. No. 2,761,791 and British Patent No. 837,095.

Techniques applicable to the present invention are also found in European Laid-Open Patent Publication Nos. EP803764A1 and EP883022A1, WO 98/36322, JP-A-9-281637, JP-A-9-297367, JP-A-9-304869, JP-A-9-311405, JP-A-9-329865, JP-A-10-10669, JP-A-10-62899, JP-A-10-69023, JP-A-10-186568, JP-A-10-90823, JP-A-10-171063, JP-A-10-186565, JP-A-10-186567, JP-A-10-186569, JP-A-10-186570, JP-A-10-186571, JP-A-10-186572, JP-A-10-197974, JP-A-10-197982, JP-A-10-197983, JP-A-10-197985, JP-A-10-197986, JP-A-10-197987, JP-A-10-207001, JP-A-10-207004, JP-A-10-221807, JP-A-10-282601, JP-A-10-288823, JP-A-10-288824, JP-A-10-307365, JP-A-10-312038, JP-A-10-339934, JP-A-11-7100, JP-A-11-15105, JP-A-11-24200, JP-A-11-24201, JP-A-11-30832, JP-A-11-84574 and JP-A-11-65021.

The photothermographic material capable of forming a black-and-white image based on silver image is preferably used as those for medical diagnosis, industrial photograph, printing and COM. Obtained black-and-white image can, of course, be used for producing a duplicated image on duplication film MI-Dup for medical diagnosis manufactured by Fuji Photo Film Co., Ltd., and used as a mask for forming an image on films for return D0-175 and PD0-100 or an offset printing plate for printing manufactured by Fuji Photo Film Co., Ltd.

In the method for producing image of the present invention, the photothermographic material, containing elsewhere at least on one plane of the support the photosensitive silver halide grain containing an iridium compound, a non-photosensitive organic silver salt, a reducing agent for silver ion and a binder, is laser exposed, heat-developed and then cooled. Such method is characterized in that the laser output for the exposure is correctively controlled according to at least a part of the temperature profile of the photothermographic material within an image producing apparatus.

The method for producing image of the present invention is practiced by using an image producing apparatus having a recording section and a heat developing section. It is more preferable to use an image producing apparatus having a cooling section in addition to the recording section and heat developing section.

In the recording section, the photothermographic material is exposed by light beam scanning using a laser beam, thereby to produce a latent image in the material. Preferable examples of the laser beam available as an exposure light source in the recording section include a gas laser ($Ar^+$, He—Ne), YAG laser, dye laser, semiconductor laser or the like. The semiconductor laser as combined with a second harmonic generation device may also be used. Preferable is a gas or semiconductor laser emitting red to infrared light. Single mode laser is available as the laser beam. The technique described in the paragraph [0140] of JP-A-11-65021 is also applicable.

Laser output is preferably 1 mW or above, more preferably 10 mW or above, and still more preferably as high as 40 mW or above. A plurality of laser beams can be superposed. Beam spot diameter can be approx. 30 to 200 $\mu$m as expressed by an $1/e^2$ spot size of a Gaussian beam.

In the heat developing section, the temperature of the photothermographic material after image-wise exposure is elevated to effect the development, thereby to visualize the latent image. Preferable development temperature is 80 to 250° C. , and more preferably 100 to 140° C. Development time is preferably 1 to 180 seconds, more preferably 10 to 90 seconds, and still more preferably 10 to 40 seconds.

As for a system of the heat developing section, the plate heater system is preferable. Heat development based on the plate heater system is preferably performed using an apparatus, as disclosed in JP-A-9-229684 or JP-A-10-177610, such that obtaining a visible image by contacting a photothermographic material, in which a latent image has been produced in the recording section, with a heating means at the heat developing section. The heating means comprises a plate heater and a plurality of pressure rollers being opposingly placed along one plane of the plate heater, which allows the photothermographic material to pass between the pressure rollers and plate heater to be heat-developed. It is preferable to section the plate heater in two to six stages, and the temperature of the endmost portion of which is set lower by 1 to 10° C. than the other portions. Such technique is disclosed also in JP-A-54-30032, and can successfully discharge the moisture and organic solvent contained in the photothermographic material out of the system, and can prevent deformation of the support of the photothermographic material due to an abrupt heating thereof.

Figure 2:
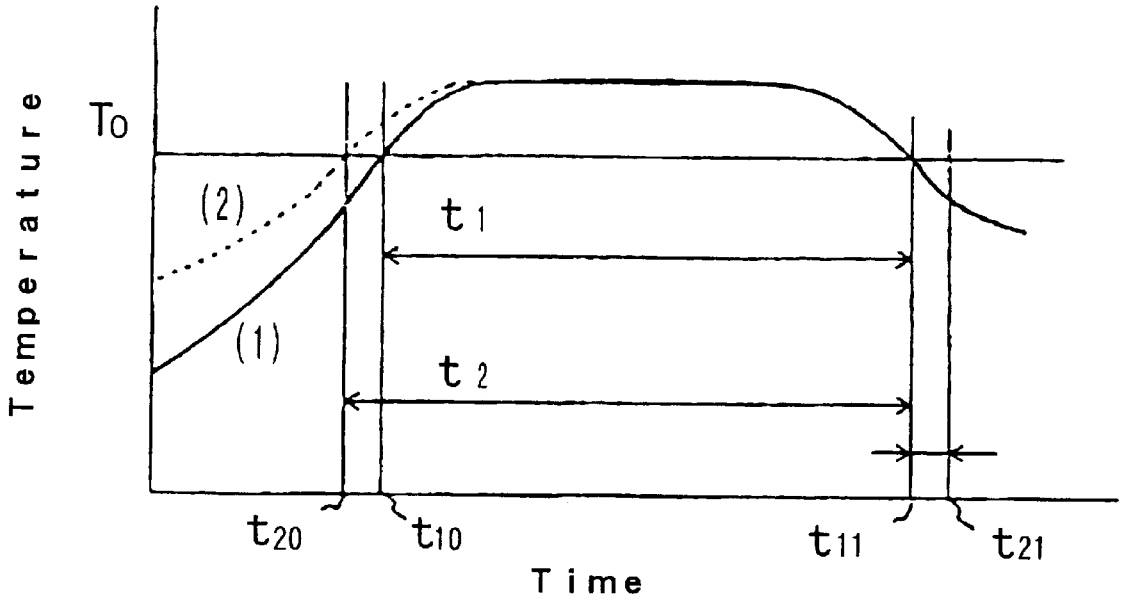
FIG. 2 is a graph showing a heat developing temperature profile of the photothermographic material.

The method for producing image of the present invention is practiced by using an image producing apparatus having an exposure correction control means for correctively controlling the exposure output according to the temperature profile of photothermographic material within such image producing apparatus. An example of the heat development temperature profile of the photothermographic material is shown in FIG. 2.

Basis on which the correction of the exposure laser output stands is the temperature profile of photothermographic material within the image producing apparatus. It is also allowable to use, besides the temperature during the heat development, for example, (1) the temperature of the photothermographic material at a feeding zone therefor or the temperature of the space within such zone, (2) the temperature of the photothermographic material immediately before entering the heat developing section, the temperature of a space around a portion through which the photothermographic material passes, or the temperature of the conveying members (e.g. a roller, belt and non-woven fabric), (3) the temperature of the cooling section in the successive stage of the heat developing section, the temperature of a space within the cooling section, the temperature of the roller and other members in the cooling section, and the temperature of the entrance of the cooling section (e.g. the temperature of a space around a portion of the passage at the entrance of the cooling section, and the temperature of the entrance roller members of the cooling section), and (4) the temperature of a stacking zone in which photothermographic materials after heat-developed and passed through the cooling zone are stacked (e.g. the temperature of stacking members and air temperature around the stacking zone). It is preferable to use the temperature of a space around a portion through which the photothermographic material passes immediately before entering the heat developing section and/or the temperature of the entrance of the cooling section. This is because the higher the temperature of the photothermographic material before entering the heat developing section becomes, the earlier the start point of the development of such photothermographic material shifts. Also this is because the higher the temperature at the entrance of the cooling section after the heat development becomes, the later the start point of the development of such photothermographic material shifts. It is further allowable to use the temperature of the stacking zone for the photothermographic material in the image producing apparatus for the corrective control. In particular, it is preferable that the image producing apparatus has a cooling section after the heat developing section, and the exposure corrective control means measures the temperature at the entrance of the cooling section so as to effect the corrective control of the output of the laser exposure according to the obtained value.

The temperature measurement may be directed to the photothermographic material per se by using an infrared sensor or the like, or may be directed to the space around a portion of the passage, a portion of the conveyance or a frame of the heat developing apparatus.

Thus obtained temperature data are used for correcting the exposure output by a luminous energy correction circuit in the control section. Preferable methods for the correction are such that (1) lowering the luminous energy as the heat development temperature before entering the heat developing section increases; and (2) lowering the luminous energy as the temperature of the entrance of the cooling section after the heat development increases.

As for a method for correcting luminous energy in relation to the image density, a significant improvement will be made only by multiplying luminous energy by a constant value irrespective of the density. Varying the correction value depending on the density is, however, more preferable.

For the case that the recording section is distant from the cooling section, the temperature of the cooling section may vary during a period from the exposure to the arrival thereto of photothermographic material even if the temperature at the entrance of the cooling section is controlled at the time of the exposure. Such problem will be cleared by providing a counter in the successive stage of the recording section, and predicting the temperature of the cooling section at a certain time point on which the photothermographic materials after the exposure will arrive (for example, one minute after the exposure), based on the number of passed photothermographic materials during a period from a certain time point before the exposure (for example, one minute before) to the exposure, and on the temperature of the cooling section at the time of the exposure. The temperature of the cooling section will rise upon the passage of the photothermographic materials. So that assuming, for example, that the temperature of the cooling section at the time of the exposure is 35° C. , two sheets of the photothermographic material are recorded within a period from 1 minute before the exposure to the exposure, and that two sheets of the photothermographic material will pass through the cooling section within a period from the exposure to 1 minute after the exposure, the temperature of the cooling section after 1 minute will be predicted as approx. 37° C.

A preferable example of the image producing apparatus available in the present invention will be explained hereinafter referring to FIG. 1.

The photothermographic materials are generally stacked (bundled) in a predetermined number of sheets (typically 100 sheets), and are provided as a package as wrapped with a bag or band. The package is housed in a magazine of a corresponding size and loaded to the individual stages of a photothermographic material feeding section 12. The photothermographic material feeding section 12 has two sheet loading sections 122, 124 so as to respectively accommodate, as housed in the magazines, the photothermographic materials of different sizes (for example, 257 mm×364 mm and 515 mm×728 mm) for arbitrary choice.

A series of processing operations described below starts upon receiving a print command.

First, with a cover of the magazine being kept opened, one sheet of the photothermographic material is taken out from the upper portion of the magazine selected by a suction cup of a sheet feeding mechanism. The photothermographic materials thus taken out is guided downstream in the direction of the conveyance by feed roller pairs, conveyance roller pairs and conveyance guide to reach a positioning section 14 located on the downstream side. The positioning section 14 refers to a section which positions the photothermographic material in the direction normal to that of the conveyance (referred as the "width direction" hereinafter) and conveys the material to the recording section 16 located downstream.

There is no special limitation on the method of side resisting in the positioning section 14. Known various methods can be exemplified, which include such that using a resist plate for positioning the photothermographic material by contacting itself to one edge in the width direction of the material, and a pushing means such as a roller for pushing the photothermographic material in the width direction to make the edge thereof pressed to the resist plate; and such that using the above-described resist plate, and a guide plate for limiting, in the width direction, the conveyance direction of the photothermographic material to make it pressed to the resist plate, being devised so as to move according to the size in the width direction of the photothermographic material.

The photothermographic material conveyed to the positioning section 14 is aligned in a direction normal to that of the conveyance as described above, and is then conveyed downstream to the recording section 16 with the aid of the conveying roller pairs.

The recording section 16 refers to a section for exposing the photothermographic material by scanning light beam, and has an sub-scanning conveying section 161 and an exposure unit 162. The exposure (recording) is effected by scanning laser beam (main scanning) while the output thereof being controlled according to image data obtained elsewhere by photographing, and by also moving (sub-scanning) the photothermographic material in a predetermined direction.

The recording section 16 has a first laser light source comprising a semiconductor laser device for emitting laser beam L0 with a basic wavelength for the recording, a collimator lens for converting the laser beam into a parallel flux and a cylindrical lens; and a second laser light source comprising a second semiconductor laser device for emitting, in the direction normal to the optical axis of the above device, laser beam L1 with a different wavelength, a collimator lens and a cylindrical lens.

Lights emitted from the individual laser light sources are superposed with the same phase after transmitted through a polarizing beam splitter, enter a polygonal mirror via a reflective mirror, and are irradiated, while being polarized, along the main scanning direction as the polygonal mirror rotates. Upon receiving image signals, a control section "A" controls a driver to regulate the rotations of the polygonal mirror and a motor, thereby the laser beam is scanned in the main scanning direction of the photothermographic material and the photothermographic material is conveyed in the sub-scanning direction.

Such kind of image recording methods for the photothermographic material are detailed, for example, in WO 95/31754 and WO 95/30934.

The photothermographic material having a latent image formed therein in the recording section 16 is then sent to the heat developing section 18 with the aid of the conveying roller pairs of the conveying section 17.

The heat developing section 18 is provided for annealing as well as heating an applicable type of the photothermographic material to be annealed, and comprises a plurality of curved plate heaters aligned along the conveying direction of the photothermographic material so as to heat the material up to a temperature desired for the processing. These plate heaters are aligned in an arc series.

In a typical constitution as shown in the figure, the heat developing section 18 has the plate heaters, each of which being oriented so as to convex upward; feed rollers as a conveying means for relatively moving (sliding) the photothermographic material while contacting the material to the surface of the plate heater; and a pressure roller for conducting heat from the plate heater to the photothermographic material. Such constitution can successfully prevent buckling of the photothermographic material since the photothermographic material is conveyed so that the front end thereof is pressed to the plate heaters.

The pressure roller and the plate heaters in together form a conveying path for the photothermographic material. Limiting a gap of the conveying path smaller than the thickness of the photothermographic material allows smooth insertion thereof and prevents the buckling. On the both ends of the conveying path for the photothermographic material, the feed roller pair and eject roller pair are provided.

These pressure rollers may be any of metal rollers, resin rollers and rubber rollers, heat conductivity of which being preferably 0.1 to 200 W/m/° C. A heat insulating cover for retaining heat is preferably provided on the opposite side of the plate heater centered round the pressure rollers.

The above-described curved plate heater is no more than one example, and any of other planar plate heaters and constitution including a heating drum, endless belt and separating pawl are of course also allowable.

The photothermographic material thus ejected from the heat developing section 18 is then carefully cooled in the cooling section 20 so as to avoid wrinkle or excessive curl. The photothermographic material came out from the cooling section 20 is guided to an guide plate with the aid of conveying roller pairs and collected through the eject roller pairs into a tray 22.

In the cooling section 20, a plurality of cooling rollers are aligned so as to provide a desired curvature R to the conveying path for the photothermographic material. This ensures the conveyance under a constant curvature until the photothermographic material is cooled to a temperature equal to or lower than a glass transition point of the component material thereof. Providing such intentional curvature to the photothermographic material can prevent excessive curl from being produced before cooled to or lower than the glass transition point, while a new curl cannot occur at the glass transition point or below, so that the degree of curling can uniformly be controlled.

Temperatures of the cooling rollers per se and the inner atmosphere of the cooling section 20 are properly controlled. Such temperature control ensures constant conditioning of the image producing apparatus in the state immediately after the start of the operation and in the state after a significant number of runs, so that variation in the optical density is suppressed.

EXAMPLE

The present invention will be explained more specifically hereinafter by referring to the following examples. The components, amounts of use thereof, ratios, operations and the like mentioned in the following examples may properly be modified without departing from the spirit of the present invention. The scope of the present invention, therefore, is not limited to the specific embodiments described below.

Spectral Sensitization Dye "A"

Tellurium Sensitizer "B"

Basic Precursor Compound 11

Cyanine Dye Compound 13

Blue Dye Compound 14

<Fabrication of PET Support>

PET with an intrinsic viscosity (IV) of 0.66 (measured in phenol/tetrachloroethane=6/4 (ratio by weight) at 25° C.) was obtained by the general procedures using terephthalic acid and ethylene glycol. The obtained PET was pelletized, dried at 130° C. for 4 hours, melted at 300° C., extruded from a T-die and rapidly cooled, to obtain a unstretched film so as to have a thickness after heat setting of 175 μm.

This film was longitudinally stretched 3.3 times using rollers different in the peripheral speed and then transversely stretched 4.5 times by a tenter at a temperature of 110° C. and 130° C., respectively. Subsequently, the film was heat-set at 240° C. for 20 seconds, and then relaxed by 4% in the transverse direction at the same temperature. Thereafter, a portion chucked by the tenter was slitted off and the film was knurled at the both edges and then taken up at 4 kg/cm$^2$. Thus, a rolled support of 175 μm thick was fabricated.

<Surface Corona Treatment>

Using a 6-kVA model of solid state corona treatment apparatus manufactured by Pillar Corporation, the both planes of the support were treated at 20 m/min under the room temperature. Referring to read values of current and voltage, it was confirmed that the support was treated at 0.375 kVA·minute/m$^2$. The treatment frequency was 9.6 kHz and the gap clearance between the electrode and dielectric roll was 1.6 mm.

<Fabrication of Undercoated Support>

(1) Preparation of Coating Liquid for the Undercoat Layer

| | |
|---|---|
| Formulation (1) (for undercoat layer on the photosensitive layer side) | |
| PESRESIN A-515GB (30 wt % solution, manufactured by Takamatsu Oil & Fat Co., Ltd.) | 234 g |
| polyethylene glycol monononylphenyl ether (average number of ethylene oxide = 8.5), 10 wt % solution | 21.5 g |
| MP-1000 (polymer microparticle, average particle size = 0.4 μm, manufactured by Soken Chemical & Engineering Co., Ltd.) | 0.91 g |
| distilled water | 744 ml |
| Formulation (2) (for a first layer on the back plane) | |
| butadiene-styrene copolymer latex (solid content = 40 wt %, ratio by weight of butadiene/styrene = 32/68) | 158 g |
| 2,4-dichloro-6-hydroxy-S-triazine sodium salt (8 wt % aqueous solution) | 20 g |
| sodium laurylbenzenesulfonate (1 wt % aqueous solution) | 10 ml |
| distilled water | 854 ml |
| Formulation (3) (for a second layer on the back plane) | |
| $SnO_2$/SbO (ratio by weight = 9/1, average particle size = 0.038 μm, 17 wt % dispersion) | 84 g |
| gelatin (10% aqueous solution) | 89.2 g |
| METHOLLOSE TC-5 (2% aqueous solution, Manufactured by Shin-Etsu Chemical Co., Ltd.) | 8.6 g |
| MP-1000 (polymer microparticle, manufactured by Soken Chemical & Engineering Co., Ltd.) | 0.01 g |
| Sodium dodecylbenzenesulfonate (1 wt % aqueous solution) | 10 ml |
| NaOH (1%) | 6 ml |
| PROXEL (manufactured by ICI Corporation) | 1 ml |
| distilled water | 805 ml |

(2) Fabrication of Undercoated Support

Both planes of the biaxially stretched polyethylene terephthalate film of 175 μm thick were individually subjected to the corona discharge treatment, the undercoat coating liquid formulation (1) was then coated using a wire bar in a wet coated amount of 6.6 ml $m^2$ on one plane (on which the photosensitive layer is to be formed) and was allowed to dry at 180° C. for 5 minutes. The undercoat coating liquid formulation (2) was then coated using a wire bar in a wet coated amount of 5.7 ml/$m^2$ on the rear plane (back plane) and was allowed to dry at 180° C. for 5 minutes. The undercoat coating liquid formulation (3) was further coated using a wire bar in a wet coated amount of 7.7 ml/$m^2$ on the rear plane (back plane) and was allowed to dry at 180° C. for 6 minutes, to obtain an undercoated support.

<Preparation of Coating Liquid for the Back Layer>

(1) Preparation of Solid Microparticle Dispersion (a) of Basic Precursor

Sixty-four grams of Basic Precursor Compound 11, 28 g of diphenylsulfone, 10 g of DEMOL-N (surfactant manufactured by KAO Corporation), and 220 ml of distilled water were mixed, and the mixture was bead-dispersed using a sand mill (¼-gallon Sand Grinder Mill manufactured by AIMEX Corporation) to obtain a solid microparticle dispersion (a) of the basic precursor compound with an average particle size or 0.2 μm.

(2) Preparation of Solid Microparticle Dispersion of Dye

To 305 ml of distilled water, added were 9.6 g of the Cyanine Dye Compound 13 and 5.8 g of sodium p-dodecylbenzenesulfonate, and the mixture was then bead-dispersed using a sand mill (¼-gallon Sand Grinder Mill manufactured by AIMEX Corporation) to obtain a solid microparticle dispersion of the dye with an average particle size or 0.2 μm.

(3) Preparation of Coating Liquid for the Antihalation Layer

Seventeen grams of gelatin, 9.6 g of polyacrylamide, 70 g of the above-described solid microperticle dispersion (a) of the basic precursor, 56 g of the above-described solid microperticle dispersion of the dye, 1.5 g of polymethyl methacrylate microperticle (average particle size=6.5 μm), 0.03 g of benzoisothiazolinone, 2.2 g of sodium polyethylenesulfonate, 0.2 g of Blue Dye Compound 14 and 844 ml of water were mixed to prepare a coating liquid for the antihalation layer.

(4) Preparation of Coating Liquid for the Protective Layer on the Back Plane

While keeping the temperature of a vessel at 40° C., 50 g of gelatin, 0.2 g of sodium polystyrenesulfonate, 2.4 g of N,N-ethylenebis(vinylsulfoneacetamide), 1 g of sodium t-octyl-phenoxyethoxyethanesulfonate, 30 mg of benzoisothiazolinone, 37 mg of potassium salt of N-perfluorooctylsulfonyl-N-propylalanine, 0.15 g of polyethyleneglycol mono(N-perfluorooctylsulfonyl-N-propyl-2-aminoethyl)ether [average degree of polymerization of ethylene oxide 15], 32 mg of $C_8F_{17}SO_3K$, 64 mg of $C_8F_{17}SO_2N(C_3H_7)(CH_2CH_2O)_4(CH_2)_4—SO_3Na$, 8.8 g of acrylic acid/ethyl acrylate copolymer (copolymerization ratio by weight=5/95), 0.6 g of Aerosol OT (product of American Cyanamide Corporation), liquid paraffin emulsion containing 1.8 g of liquid paraffin, and 950 ml of water were mixed to obtain a coating liquid for the protective layer on the back plane.

<Preparation of Silver Halide Emulsion 1-A: Sample of the Present Invention>

To 1421 ml of distilled water, 8.0 ml of an 1 wt % potassium bromide solution was added, and 8.2 ml of an 1N nitric acid and 20 g of phthalized gelatin were further added. The obtained mixture was kept stirred in a titanium-coated stainless reaction vessel at a constant liquid temperature of 37° C., and was then added with an entire volume of solution "A" obtained by dissolving 37.04 g of silver nitrate in distilled water and diluting it up to 159 ml, by the controlled double jet method at a constant flow rate over 1 minute while keeping pAg at 8.1. Solution "B" obtained by dissolving 32.6 g of potassium bromide in water and diluting it up to 200 ml was also added by the controlled double jet method. After that, 30 ml of a 3.5 wt % aqueous hydrogen peroxide solution was added, and 36 ml of a 3 wt % aqueous solution of benzimidazole was further added. Solution "A" was further diluted with distilled water to 317.5 ml to obtain solution "A2", and solution "B" was further added with tripotassium hexachloroiridate so as to attain a final concentration thereof of $1\times10^{-4}$ mol per one mol of silver and diluted with distilled water up to 400 ml, thereby to obtain solution "B2". Again an entire volume of solution "A2" was added to the mixture by the controlled double jet method at a constant flow rate over 10 minutes while keeping pAg at 8.1. Solution "B2" was also added by the controlled double jet method. After that, the mixture was added with 50 ml of a 0.5% methanol solution of 5-methyl-2-mercaptobenzimidazole, the pAg adjusted to 7.5 with silver nitrate, the pH then adjusted to 3.8 with an 1N sulfuric acid, stopped stirring, subjected to precipitation/desalting/washing processes, added with 3.5 g of deionized gelatin, the pH and pAg adjusted to 6.0 and 8.2, respectively, with an 1N sodium hydroxide, thereby to obtain a silver halide emulsion.

Particle in the resultant silver halide emulsion was found to be a pure silver bromide particle with an average sphere-equivalent diameter of 0.053 μm and a sphere-equivalent coefficient of variation of 18%. Particle size and so forth were determined based on an average diameter of 1000 particles under electron microscopic observation. Ratio of [100] plane of such particle was determined as 85% based on the method of Kubelka-Munk.

The above emulsion was kept at 38° C. under stirring, and 0.035 g of benzoisothiazolinone was added in a form of a 3.5 wt % methanol solution thereto. Forty minutes after, a solid dispersion of Spectral Sensitizing Dye "A" (aqueous gelatin solution) was added thereto in an amount of $5\times10^{-3}$ mol per one mol of silver, the temperature thereof was raised to 47° C. one minute after, sodium benzenethiosulfonate was added thereto 20 minutes after in an amount of $3\times10^{-5}$ mol per one mol of silver, Tellurium Sensitizer "B" was added thereto 2 minutes after in an amount of $5\times10^{-5}$ mol per one mol of silver, and was then ripened for 90 minutes. Immediately before completion of the ripening, 5 ml of a 0.5 wt % methanol solution of N,N'-dihydroxy-N"-diethylmelamine was added, temperature of which was lowered to 31° C., and 5 ml of a 3.5 wt % methanol solution of phenoxyethanol, $7\times10^{-3}$ mol per one mol of silver of 5-methyl-2-mercaptobenzimidazole, and $6.4\times10^{-3}$ mol per one mol of silver of 1-phenyl-2-heptyl-5-mercapto-1,3,4-triazole were added, thereby to obtain a silver halide emulsion 1-A.

<Preparation of Silver Halide Emulsion 2-A: Sample of the Present Invention>

An emulsion containing pure cubic silver bromide particle with an average sphere-equivalent diameter of 0.08 μm and a sphere-equivalent coefficient of variation of 15% was prepared similarly to the preparation of silver halide emulsion 1-A except that the temperature of the mixed solution during the particle formation was raised to 50° C., in place of 37° C. Precipitation/desalting/ washing/dispersion were performed similarly to those in the case of silver halide emulsion 1-A. Except that the amount of addition of Spectral Sensitization Dye "A" is altered to $4.5\times10^{-3}$ mol per one mol of silver, the spectral sensitization, chemical sensitization, addition of 5-methyl-2-mercaptobenzimidazole and addition of 1-phenyl-2-heptyl-5-mercapto-1,3,4-triazole were also performed similarly to those in the case of the emulsion 1-A, thereby to obtain a silver halide emulsion 2-A.

<Preparation of Silver Halide Emulsion 3-A: Sample of the Present Invention>

An emulsion containing pure cubic silver bromide particle with an average sphere-equivalent diameter of 0.038 μm and a sphere-equivalent coefficient of variation of 20% was prepared similarly to the preparation of silver halide emulsion 1-A except that the temperature of the mixed solution during the particle formation was lowered to 27° C. , in place of 37° C. Precipitation/desalting/washing/dispersion were performed similarly to those in the case of silver halide emulsion 1-A. Except that the amount of addition of Spectral Sensitization Dye "A" is altered to $6\times10^{-3}$ mol per one mol of silver, the spectral sensitization, chemical sensitization, addition of 5-methyl-2-mercaptobenzimidazole and addition of 1-phenyl-2-heptyl-5-mercapto-1,3,4-triazole were also performed similarly to those in the case of the emulsion 1-A, thereby to obtain a silver halide emulsion 3-A.

<Preparation of Silver Halide Emulsions 1-B, 2-B and 3-B: Comparative Samples>

Silver halide emulsions 1-B, 2-B and 3-B were prepared similarly to the preparation of the silver halide emulsions 1-A, 2-A and 3-A, except that tripotassium hexachloroiridate was not added. Also the particle shape and size were same as above.

<Preparation of Mixed Silver Halide Emulsion "A": Silver Halide Emulsion for Inventive Sample, and Mixed Silver Halide Emulsion "B": Silver Halide Emulsion for Comparative Sample>

Mixed silver halide emulsion "A" was prepared by mixing 70 wt % of silver halide emulsion 1-A, 15 wt % of silver halide emulsion 2-A and 15 wt % of silver halide emulsion 3-A, and by further adding thereto an 1 wt % aqueous solution of benzothiazolium iodide in an amount of $7\times10^{-3}$ mol per one mold of silver. Similarly, mixed silver halide emulsion "B" was prepared using silver halide emulsions 1-B, 2-B and 3-B.

<Preparation of Scaly Fatty Acid Silver Salt>

Sodium behenate solution was prepared by mixing 87.6 g of behenic acid (Edenor C22-85R, product of Henkel Corporation), 423 ml of distilled water, 49.2 ml of a 5N aqueous NaOH solution and 120 ml of tert-butanol, and allowing the mixture to react at 75° C. for one hour under stirring. Independently, 206.2 ml of aqueous solution containing 40.4 g of silver nitrate (pH 4.0) was prepared and kept at 10° C. A reaction vessel containing 635 ml of distilled water and 30 ml of tert-butanol was kept at 30° C., and an entire volume of the sodium behenate solution and an entire volume of the silver nitrate aqueous solution were added at constant flow rates over 62 minutes and 10 second, and over 60 minutes, respectively. In this process, only the silver nitrate aqueous solution was added in a first 7-minute-and-20-second period after the start of the addition, then sodium behenate solution was concomitantly added, and only sodium behenate solution was added in a last 9-minute-and-30-second period after the end of addition of the aqueous silver nitrate solution. The temperature in the reaction vessel is kept at 30° C., and was controlled externally so as to keep the liquid temperature constant. A piping in a feeding system of the sodium behenate solution was heated using a steam trace, where a steam aperture being adjusted so as to control the outlet liquid temperature at the end of the feed nozzle at 75° C. A piping in a feeding system of the aqueous silver nitrate solution was heated by circulating cold water in an outer portion of the double pipe. Points of addition of the sodium behenate solution and silver nitrate aqueous solution were symmetrically arranged centered around a stirring axis, the heights of which being adjusted so as to avoid contact to the reaction solution.

After completion of the addition of the sodium behenate solution, the mixture was allowed to stand for 20 minutes under stirring with the temperature thereof unchanged, and then cooled to 25° C. The solid content was separated by suction filtration, and then washed with water until electric conductivity of the filtrate decreased as low as 30 μS/cm. A fatty acid silver salt was thus obtained. The obtained solid content was stored in a form of a wet cake without drying.

From electron microscopic photographing, the obtained silver behenate particle was found to be a scaly crystal having average lengths of a=0.14 μm, b=0.4 μm and c=0.6 μm, an average sphere-equivalent diameter of 0.52 μm, a sphere-equivalent coefficient of variation of 15% (a, b and c comply with the definition in this specification).

To the wet cake equivalent to dry weight of 100 g, 7.4 g of polyvinyl alcohol (product name; PVA-217) and water were added to adjust a total volume of 385 g, and the mixture was then preliminarily dispersed using a homomixer.

The preliminarily dispersed solution was then thoroughly dispersed three times using a dispersion apparatus (Micro Fluidizer M-110S-EH, manufactured by Micro Fluidex International Corporation, equipped with G10Z interaction chamber) under a pressure of 1750 kg/cm$^2$, to obtain a silver behenate dispersion. During the dispersion, cooling operation was effected using coiled heat exchangers attached to the inlet side and outlet side of the interaction chamber, and the temperature of the coolant was controlled to keep the dispersion temperature at 18° C.

<Preparation of 25 wt % Dispersion of Reducing Agent>

Ten kilograms of 1,1-bis(2-hydroxy-3,5-dimethylphenyl)-3,5,5-trimethylhexane and 10 kg of a 20 wt % aqueous solution of a modified polyvinylalcohol (Poval MP-203, manufactured by Kuraray Co., Ltd.) were added with 16 kg of water, and then mixed thoroughly to prepare a slurry. The slurry was then fed with the aid of a diaphragm pump to a lateral sand mill (UVM-2, manufactured by Aimex, Ltd.) packed with zirconia bead with an average diameter of 0.5 mm, dispersed for 3.5 hours, added with 0.2 g of benzoisothiazolinone sodium salt and water so as to adjust the concentration of the reducing agent to 25 wt %, thereby to obtain a dispersion of the reducing agent. Reducing agent particle contained in thus obtained dispersion was found to have a median diameter of 0.42 μm and a maximum diameter of 2.0 a m or less. The obtained reducing agent dispersion was filtered through a polypropylene filter with a pore size of 10. 0 μm to separate dust or other foreign matters and then stored.

<Preparation of 10 wt % Dispersion of Mercapto Compound>

Five kilograms of 1-phenyl-2-heptyl-5-mercapto-1,3,4-triazole and 5 kg of a 20 wt % aqueous solution of a modified polyvinyl alcohol (Poval MP-203, manufactured by Kuraray Co., Ltd.) were added with 8.3 kg of water, and then mixed thoroughly to prepare a slurry. The slurry was then fed with the aid of a diaphragm pump to a lateral sand mill (UVM-2, manufactured by Aimex, Ltd.) packed with zirconia bead with an average diameter of 0.5 mm, dispersed for 6 hours, added with water so as to adjust the concentration of the mercapto compound to 10 wt %, thereby to obtain a dispersion of the mercapto compound. Mercapto compound particle contained in thus obtained dispersion was found to have a median diameter of 0.40 μm and a maximum diameter of 2.0 μm or less. The obtained mercapto compound dispersion was filtered through a polypropylene filter with a pore size of 10.0 μm to separate dust or other foreign matters and then stored. The dispersion was filtered again immediately before use through a polypropylene filter with a pore size of 10.0 μm.

<Preparation of 20 wt % Dispersion-1 of Organic Polyhalogen Compound-1>

Five kilograms of tribromomethylnaphthylsulfone, 2.5 kg of a 20 wt % aqueous solution of a modified polyvinylalcohol (Poval MP-203, manufactured by Kuraray Co., Ltd.), and 213 g of a 20 wt % aqueous solution of sodium triisopropylnaphthalenesulfonate were added with 10 kg of water, and then mixed thoroughly to prepare a slurry. The slurry was then fed with the aid of a diaphragm pump to a lateral sand mill (UVM-2 manufactured by Aimex, Ltd.) packed with zirconia bead with an average diameter of 0.5 mm, dispersed for 5 hours, added with 0.2 g of benzoisothiazolinone sodium salt and water so as to adjust the concentration of the organic polyhalogen compound to 20 wt %, thereby to obtain a dispersion of the organic polyhalogen compound. Organic polyhalogen compound particle contained in thus obtained dispersion was found to have a median diameter of 0.36 μm and a maximum diameter of 2.0 μm or less. The obtained organic polyhalogen compound dispersion was filtered through a polypropylene filter with a pore size of 3.0 μm to separate dust or other foreign matters and then stored.

<Preparation of 20 wt % Dispersion-2 of Organic Polyhalogen Compound>

Dispersion was performed similarly to the case with the 20 wt % dispersion-1 of the organic polyhalogen compound, except that 5 kg of tribromomethyl(4-(2,4,6-trimethylphenylsulfonyl)phenyl) sulfone was used in place of 5 kg of tribromomethylnaphthylsulfone, the obtained dispersion is diluted so as to attain a concentration of the organic polyhalogen compound of 25 wt %, and then filtered. Organic polyhalogen compound particle contained in thus obtained dispersion was found to have a median diameter of 0.38 μm and a maximum diameter of 2.0 μm or less. The obtained organic polyhalogen compound dispersion was filtered through a polypropylene filter with a pore size of 3.0 μm to separate dust or other foreign matters and then stored.

<Preparation of 20 wt % Dispersion-3 of Organic Polyhalogen Compound>

Dispersion was performed similarly to the case with the 20 wt % dispersion-1 of the organic polyhalogen compound except that 5 kg of tribromomethylphenylsulfone was used in place of 5 kg of tribromomethylnaphthylsulfone, the obtained dispersion is diluted so as to attain a concentration of the organic polyhalogen compound of 30 wt %, and then filtered. Organic polyhalogen compound particle contained in thus obtained dispersion was found to have a median diameter of 0.41 μm and a maximum diameter of 2.0 μm or less. The obtained organic polyhalogen compound dispersion was filtered through a polypropylene filter with a pore size of 3.0 μm to separate dust or other foreign matters and then stored at 10° C. or below until it is used.

<Preparation of 10 wt % Methanol Solution of Phthalazine Compound>

Ten grams of 6-isopropylphthalazine was dissolved in 90 g of methanol to prepare a 10 wt % methanol solution of such phthalazine compound.

<Preparation of 20 wt % Dispersion of Pigment>

Sixty-four grams of C.I. Pigment Blue 60 and 6.4 g of DEMOL-N (manufactured by Kao Corporation) were added with 250 g of water, and then mixed thoroughly to prepare a slurry. The slurry was then fed into a vessel of a dispersion apparatus (1/4G Sand Grinder Mill manufactured by Aimex, Ltd.) together with 800 g of zirconia bead with an average diameter of 0.5 mm, and dispersed for 25 hours to obtain a pigment dispersion. Pigment particle contained in thus obtained dispersion was found to have an average diameter of 0.21 μm.

<Preparation of 40 wt % Solution of SBR Latex>

SBR latex purified by ultrafiltration was obtained as follows:

A ten-fold diluted aqueous solution of the SBR latex shown below was purified by dilution using an UF-purification module FS03-FC-FUY03A1 (manufactured by Daicen Membrane-Systems Ltd.) until the ion conductivity is reduced as low as 1.5 mS/cm. Sandet-BL (manufactured by Sanyo Chemical Industries) was then added so as to attain a concentration of 0.22 wt %, and NaOH and $NH_4OH$ were further added so as to attain a molar ratio of $Na^+:NH_4^+=1:2.3$ and a pH of 8.4. The resultant latex concentration was found to be 40 wt %.

(SBR latex: expressed as -St(68)-Bu(29)-AA(3)-) average particle size=0.1 μm, concentration=45%, equilibrium moisture content at 25° C., 60%RH=0.6 wt %, ion conductivity=4.2 mS/cm (measured for latex solution (40%) at 25° C. using a conductometer CM-30S manufactured by TOA Electronics Ltd.), pH8.2.

<Preparation of Coating Liquid for Photosensitive Layer: Inventive and Comparative Samples>

Mixed were 1.1 g of the above-obtained 20 wt % dispersion of the pigment, 103 g of the organic acid silver dispersion, 5 g of a 20 wt % aqueous solution of polyvinyl alcohol PVA-205 (product of Kuraray Co., Ltd.), 25 g of the above-obtained 25 wt % dispersion of the reducing agent, total 16.3 g of 5:1:3 mixture (ratio by weight) of dispersions-1 , -2 and -3 of the organic polyhalogen compounds, 6.2 g of the 10 wt % dispersion of the mercapto compound, 106 g of the 40 wt % solution of SBR latex purified by ultrafiltration and pH adjusted, and 16 ml of the 10 wt % methanol solution of the phthalazine compound. Ten grams of silver halide mixed emulsion "A" or "B" was further added, and the mixture was then thoroughly mixed to obtain a coating liquid for the photosensitive layer for an inventive sample or comparative sample, which was then directly fed to a coating die and coated in an amount of 70 $ml/m^2$.

Viscosity of the coating liquid for the photosensitive layer for the inventive sample was measured using a B-type viscometer (manufactured by Tokyo Keiki K.K.) at 40° C., (with No. 1 rotor at 160 rpm) and was found to be 85 mPa·s. Viscosities of the coating liquid measured under shearing velocities of 0.1, 1, 10, 100 and 1000 (1/second) at 25° C. using RFS Fluid Spectrometer (manufactured by Rheometrix Far East Inc.) were 1500, 220, 70, 40 and 20 mPa·s, respectively.

<Preparation of Coating Liquid for Intermediate Layer on the Photosensitive Plane>

A coating liquid for the intermediate layer was prepared by mixing 772 g of a 10 wt % aqueous solution of polyvinyl alcohol PVA-205 (product of Kuraray Co., Ltd.), 5.3 g of the 20 wt % dispersion of the pigment, 226 g of a 27.5 wt % solution of methyl methacrylate/styrene/butyl acrylate/hydroxyethyl methacrylate/acrylic acid copolymer latex (copolymerization ratio by weight of 64/9/20/5/2), 2 ml of a 5 wt % aqueous solution of Aerosol OT (American Cyanamide Corporation), and 10.5 ml of a 20 wt % aqueous solution of diammmonium phthalate, and by adding water to adjust a total weight of 880 g. The liquid was then fed to a coating die so as to attain a coating amount of 10 ml/m$^2$. Viscosity of the coating liquid measured at 40° C. using a B-type viscometer (with No. 1 rotor at 160 rpm) was found to be 21 mPa·s.

<Preparation of Coating Liquid for First Protective Layer on the Photosensitive Plane>

Sixty-four grams of inert gelatin was dissolved in water, and added thereto were 80 g of a 27.5 wt % solution of methyl methacrylate/styrene/butyl acrylate/hydroxyethyl methacrylate/acrylic acid copolymer latex (copolymerization ratio by weight of 64/9/20/5/2), 64 ml of a 10 wt % methanol solution of phthalic acid, 74 ml of a 10 wt % aqueous solution of 4-methylphthalic acid, 28 ml of an 1N sulfuric acid, 5 ml of a 5 wt % aqueous solution of Aerosol 0T (American Cyanamide Corporation), 0.5 g of phenoxyethanol, and 0.1 g of benzoisothiazolinone, and was further added with water to adjust a total weight of 1000 g, thereby to obtain a coating liquid. The coating liquid was added with 26 ml of a 4 wt % solution of chrome alum using a static mixer immediately before the coating, and was then fed to a coating die so as to attain a coating amount of 18.6 ml/m$^2$. Viscosity of the coating liquid measured at 40° C. using a B-type viscometer (with No. 1 rotor at 160 rpm) was found to be 17 mPa·s.

<Preparation of Coating Liquid for Second Protective Layer on the Photosensitive Plane>

Eighty grams of inert gelatin was dissolved in water, and added thereto were 102 g of a 27.5 wt % solution of methyl methacrylate/styrene/butyl acrylate/hydroxyethyl methacrylate/acrylic acid copolymer latex (copolymerization ratio by weight of 64/9/20/5/2), 3.2 ml of a 5 wt % solution of N-perfluorooctylsulfonyl-N-propylalanine potassium salt, 32 ml of a 2 wt % aqueous solution of polyethyleneglycolmono(N-perfluorooctylsulfonyl-N-propyl-2-aminoethyl) ether [average degree of polymerization of ethylene oxide 15], 23 ml of a 5 wt % aqueous solution of Aerosol 0T (American Cyanamide Corporation), 4 g of polymethyl methacrylate microparticle (average particle size=0.7 μm), 21 g of polymethylmethacrylate microparticle (average particle size=6.4 μm), 1.6 g of 4-methylphthalic acid, 8.1 g of phthalic acid, 44 ml of an 1N sulfuric acid, and 10 mg of benzoisothiazolinone, and was further added with water to adjust a total weight of 650 g. The mixture was added with 445 ml of an aqueous solution containing 4 wt % chrome alum and 0.67% of phthalic acid using a static mixer immediately before the coating, thereby to obtain a coating liquid for a second protective layer, and was then fed to a coating die so as to attain a coating amount of 8.3 ml/m$^2$. Viscosity of the coating liquid measured at 40° C. using a B-type viscometer (with No. 1 rotor at 160 rpm) was found to be 9 mPa·S. <Fabrication of Photothermographic material: Inventive and Comparative Samples>

On the back plane of the undercoated support, the coating liquid for the antihalation layer and the coating liquid for the back plane protective layer were simultaneously coated in a stacked manner, so as to attain a coated amount of 0.04 g/m$^2$ in terms of solid content of the solid particle dye for the former, and 1.7 g/m$^2$ in terms of gelatin for the latter, respectively. The coated films were then dried to obtain a back layer for preventing halation.

On the opposite plane of the back plane and on the undercoat layer, a photosensitive layer for the inventive or comparative sample (in a coated amount of 0.14 g/m$^2$ as silver in the silver halide), an intermediate layer, a first protective layer and a second protective layer were formed in this order by the simultaneous stackable coating based on the slide bead coating method, thereby to obtain an inventive or comparative sample of the photothermographic material.

The coating was effected at a speed of 160 m/min while keeping a gap between the end of the coating die and the support at 0.14 to 0.28 mm, and adjusting so that coating width becomes wider than the width of the slit for ejecting the coating liquid by 0.5 mm each from the both edges, and keeping a pressure in a reduced pressure chamber lower by 392 Pa than the atmospheric pressure. Care was taken for handling and controlling temperature and humidity so as to prevent electric charging of the support, and charging was cancelled by blowing ion wind immediately before the coating. Next, the coated liquid was cooled in a chilling zone by blowing wind with a dry-bulb temperature of 18° C. and a wet-bulb temperature of 12° C. for 30 seconds, further dried in a helical floating drying zone by blowing wind with a dry-bulb temperature of 30° C. and a wet-bulb temperature of 18° C. for 200 seconds, still further dried by passing it into a drying zone at 70° C. for 30 seconds and then at 90° C. for 10 seconds, then cooled to 25° C. to vaporize the solvent in the coated liquid. The average velocity of the wind blown onto the surface of the coated liquid in the chilling zone and drying zone was 7 m/sec. <Image Producing Apparatus>

An image producing apparatus shown in FIG. 1 was used.

The image producing apparatus has a laser exposure section (see below for details), and a heat developing section in which heat drums are aligned so as to effect processing at 118° C. for 5 seconds, and then at 122° C. for 16 seconds.

Laser exposure section:

35 mW outputs from two 660-nm diode laser units superposed, single-mode, Gaussian beam spot size $1/e^2$=100 μm, shifting with a 25-μm pitch in the sub-scanning direction, quadruple writing for one pixel Both types of the image producing apparatuses with or without temperature sensors B1, B2 and B3 were used; the temperature sensor B1 being provided for measuring the air temperature around a portion through which the photothermographic material passes immediately before entering the heat developing section, the temperature sensor B2 being provided for measuring the air temperature around a portion at the inlet of the cooling section through which the photothermographic material passes, and the temperature sensor B3 being provided for measuring the temperature of a stacking zone (feeding zone) for storing the photothermographic material before the exposure.

Figure 3:
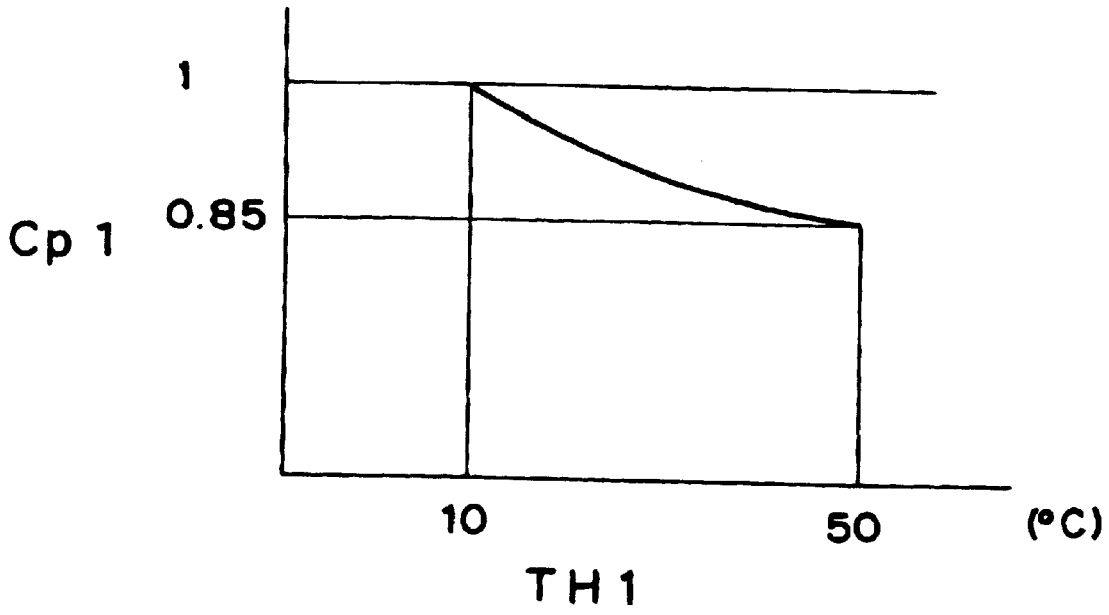
FIG. 3 is a graph showing a relation between temperature TH1 and the corrected value Cp1.
Figure 4:
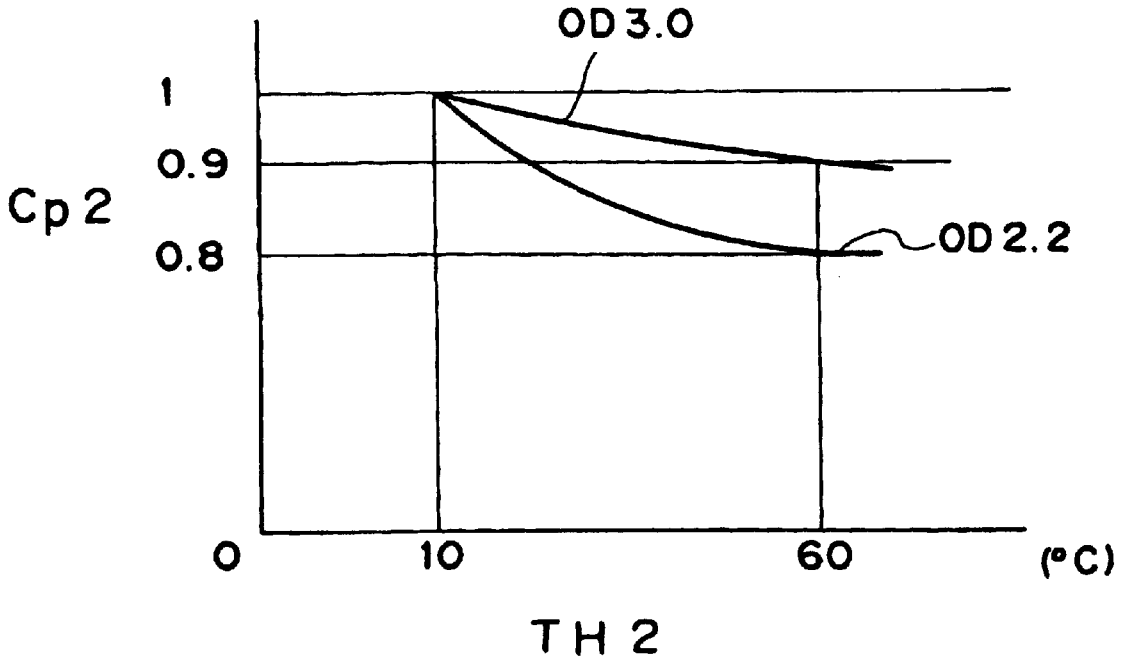
FIG. 4 is a graph showing a relation between temperature TH2 and the corrected value Cp2.

As for the image producing apparatus equipped with these three sensors, corrective controls as shown in FIGS. 3 and 4 were provided based on temperature TH1 obtained by the temperature sensor B1, temperature TH2 obtained by the temperature sensor B2 and temperature TH3 obtained by the temperature sensor B3. FIG. 3 shows a relation between temperature TH1 and correction value Cp1, and FIG. 4 shows a relation between temperature TH2 and correction value Cp2. As is typically found from FIG. 3, TH1=10° C. gives correction value Cp1=1, where the correction value gradually decreases as the temperature rises, which results in correction value Cp1=0.85 for TH1=50° C. The correction value also relates to an optical density (OD), where a higher density gives a smaller correction value. For example, as shown in FIG. 4, TH2=60° C. results in Cp2=0.9 for an optical density of 3.0, whereas it results in Cp2=0.8 for an optical density of 2.2. Correction value Cp3 corresponding to TH3 is defined as half of the correction values derived from FIG. 3. Image recording was performed using a corrected luminous energy L1 derived by the following equation involving thus obtained values Cp1, Cp2 and Cp3, and an uncorrected luminous energy L0.

$$L1=L0\times Cp1\times Cp2\times Cp3$$

<Evaluation of Photographic Properties>

Exposure and heat development were performed using the above image producing apparatuses, and obtained images were evaluated using a densitometer.

(1) Evaluation of Temperature Dependence

The photothermographic materials according to the inventive sample and comparative sample were respectively loaded to the image producing apparatuses, allowed to stand for 4 hours in the rooms respectively conditioned at 30° C. and a humidity of 15%, and at 15° C. and a humidity of 15%, exposed as described above, and relative sensitivities of which were determined from exposure energies required for affording an optical density of 1.0, and the photographic properties were evaluated based on the sensitivity ratios given by the equation below:

sensitivity ratio=sensitivity at 30° C., 15%/sensitivity at 15° C., 15%

(2) Evaluation of Humidity Dependence

The photothermographic materials according to the inventive sample were respectively loaded to the image producing apparatuses with and without the temperature sensors, allowed to stand for 4 hours in the rooms respectively conditioned at 25° C. and a humidity of 75%, at 25° C. and a humidity of 15%, exposed as described above, andrelative sensitivities of which were determined from exposure energies required for affording an optical density of 1.0, and the photographic properties were evaluated based on the sensitivity ratios given by the equation below:

sensitivity ratio=sensitivity at 25° C., 75% / sensitivity at 25° C., 15%

Results were shown in the Table below. A quality image not affected by the temperature nor humidity was successfully obtained sing the iridium-containing photosensitive silver halide under control using the temperature sensors in the image producing apparatus.

TABLE

| | Emulsion for Photothermographic Material | Control by Temperature Sensors in Image Producing Apparatus | Sensitivity Ratio | |
|---|---|---|---|---|
| | | | Temperature Dependence | Humidity Dependence |
| 1 (Comp.) | A | no | 1.1 | 2.3 |
| 2 (Inv.) | A | yes | 1.1 | 1.0 |
| 3 (Comp.) | B | no | 2.0 | 1.4 |
| 4 (Comp.) | B | yes | 2.0 | 1.0 |

As has been described above, the method for producing image the present invention can provide an image with a stable quality le not being affected by environmental conditions during the image production. The method for producing image of the present invention suitably be applied to, for example, an image producing system medical diagnosis.

What is claimed is:

1. A method for producing image on a photothermographic material which comprises:

exposing the photothermographic material with a laser light of an image producing apparatus having a recording section and heat developing section, and then developing by heating the photothermographic material containing a support, photosensitive silver halide, a non-photosensitive organic silver salt, a reducing agent for silver ion and a binder;

wherein the photosensitive silver halide contains an iridium compound, and the image producing apparatus has laser corrective control means for correctively controlling the laser output according to a temperature profile of said photothermographic material within said apparatus.

2. A method for producing image as claimed in claim 1, wherein the laser corrective control means measures the temperature of photothermographic material immediately before entering the heat developing section and correctively controls the output of the laser based on the measured values.

3. A method for producing image as claimed in claim 2, wherein the laser corrective control is effected by the laser corrective control means so as to lower the laser output as the temperature immediately before entering the heat developing section rises, and so as to raise the laser output as the temperature decreases.

4. A method for producing image as claimed in claim 1, wherein the image producing apparatus has a cooling section in the successive stage of the heat developing section, and the laser corrective control means measures the temperature at the entrance of the cooling section so as to effect the laser corrective control of the output of the laser according to the obtained value.

5. A method for producing image as claimed in claim 4, wherein the laser corrective control is effected by the laser corrective control means so as to lower the laser output as the temperature at the entrance of the cooling section rises, and so as to raise the laser output as the temperature decreases.

6. A method for producing image as claimed in claim 5, wherein the laser corrective control is effected by the laser corrective control means so as to raise the laser output as the image density increases, and so as to lower the laser output as the image density decreases.

7. A method for producing image as claimed in claim 5, wherein the laser corrective control such that lowering the laser output as the temperature immediately before entering the heat developing section rises and raising the laser output as the temperature decreases is combined with the laser corrective control such that lowering the laser output as the temperature at the entrance of the cooling section rises and raising the laser output as the temperature decreases.

8. A method for producing image as claimed in claim 7, wherein the laser corrective control means measures the temperature of a stacking zone accumulating the photothermographic materials before the exposure with laser and further correctively controls the output of the laser based on the measured values.

9. A method for producing image as claimed in claim 8, wherein the laser corrective control is effected so as to lower the laser output as the temperature of a stacking zone rises and raise the laser output as the temperature decreases.

10. A method for producing image as claimed in claim 1, wherein the photosensitive silver halide contains an iridium compound selected from the group consisting of hexachloroiridium, hexammineiridium, trioxalatoiridium, hexacyanoiridium and pentachloronitrosyliridium.

11. A method for producing image as claimed in claim 1, wherein the photosensitive silver halide contains the iridium compound in an amount of $1\times10^{-8}$ to $1\times10^{-3}$ mol per one mol of silver halide.

12. A method for producing image as claimed in claim 11, wherein the photosensitive silver halide contains the iridium compound in an amount of $1\times10^{-7}$ to $5\times10^{-4}$ mol.

* * * * *